US005174557A

United States Patent [19]

Meier

[11] Patent Number: 5,174,557

[45] Date of Patent: Dec. 29, 1992

[54] APPARATUS FOR STAPLING MULTIPART PRINTED PRODUCTS

[75] Inventor: Jacques Meier, Bäretswil, Switzerland

[73] Assignee: Ferag AG, Hinwil, Switzerland

[21] Appl. No.: 740,881

[22] Filed: Aug. 6, 1991

[30] Foreign Application Priority Data

Aug. 6, 1990 [CH] Switzerland ..... 2564/90

[51] Int. Cl.[5] ..... B41L 43/12; B42B 2/00

[52] U.S. Cl. ..... 270/38; 270/53; 270/37

[58] Field of Search ..... 270/37, 38, 53

[56] References Cited

U.S. PATENT DOCUMENTS

| | | | |
|---|---|---|---|
| 1,711,960 | 5/1929 | Moris | 270/35 |
| 3,915,445 | 10/1975 | Duncun | 270/37 |
| 4,641,825 | 2/1987 | Mowry et al. | 270/53 |
| 4,650,174 | 3/1987 | Stobb | 270/53 |
| 4,750,661 | 6/1988 | Pane | 227/7 |
| 4,792,077 | 12/1988 | Faltin | 227/81 |
| 4,840,364 | 6/1989 | Schneider | 270/38 |
| 4,892,297 | 1/1990 | Kobler | 270/38 |

FOREIGN PATENT DOCUMENTS

| | | | |
|---|---|---|---|
| 399317 | 12/1990 | European Pat. Off. . | |
| 1157632 | 11/1963 | Fed. Rep. of Germany | 270/38 |
| 3203376A1 | 8/1983 | Fed. Rep. of Germany . | |
| 834556 | 11/1938 | France . | |
| 459145 | 7/1968 | Switzerland . | |
| 740079 | 11/1955 | United Kingdom . | |
| 2123389A | 2/1984 | United Kingdom . | |
| 2176174 | 12/1986 | United Kingdom | 270/53 |

*Primary Examiner*—John T. Kwon
*Assistant Examiner*—John Ryznic
*Attorney, Agent, or Firm*—Willian Brinks Olds Hofer Gilson & Lione

[57] ABSTRACT

Printed products are stapled by guiding them between a stapling-head arrangement and a staple-closing arrangement. The stapling-head arrangement comprises a number of stapling heads revolvingly moved along a closed revolving path. A section of this closed revolving path thereby extends substantially parallel to the travel path of the printed products. The staple-closing arrangement comprises a number of countersupports likewise moved along a closed revolving path also having a section extending substantially parallel to the travel path of the printed products. A countersupport co-acts in each case with a stapling head to close the respective inserted staple. Consequently, during the stapling operation, the stapling heads and the countersupports run along and cover a certain distance together with the respective printed products to be stapled.

65 Claims, 9 Drawing Sheets

APPARATUS FOR STAPLING MULTIPART PRINTED PRODUCTS

BACKGROUND OF THE INVENTION

The present invention broadly relates to apparatus for applying staples or wire staples to substantially flat articles or products and, more specifically, pertains to a new and improved apparatus for stapling multipart or multisheet printed products, particularly newspapers, magazines, brochures and the like. The present invention also relates to a new and improved method for stapling printed products in the folded-product delivery of a rotary printed press of machine.

Generally speaking, the stapling apparatus of the present development is of the type for stapling multipart printed products selectively arriving as individual products or in a contiguously joined formation as a multilayered web.

A stitcher for signatures and webs is known from and disclosed in, for example, U.S. Pat. No. 4,315,588 and its corresponding German Patent Application No. 3,203,376, published Aug. 4, 1983. According to this prior art construction, the web or signature sheets to be stapled are guidedly moved between respective cooperating staple-inserting elements and staple-clenching elements. The staple-inserting elements and the staple-clenching elements are carried by respective continuously revolving chain link assemblies having respective runs which extend parallel to the direction of travel of the products and contiguously to the travel pathway of the latter. The staple-inserting elements and the staple-clenching elements located opposite the latter during the stapling operation are synchronously on-line with the signatures during stapling.

A further revolving path formed by male die and transport members mounted at an endless revolving chain link assembly is provided in order to form the staples to be inserted. At the revolving path of these male die and transport members there is arranged a rotary cutter to supply straight cut lengths of wire to the male die and transport members contiguously passing by. The straight cut length of wire is bent or deformed to form a substantially U-shaped staple when the respective male die mates with a female shaping die carried by the contiguously traveling central chain link assembly. In this manner the staple is held in the female shaping die which transports the latter to the stapling zone and acts there as the aforementioned staple-inserting element for ejecting and passing the staple through the oncoming signature, or the like.

This known apparatus for stitching moving paper articles is relatively complicated in construction and design. In this apparatus three adjacent revolving paths defining two contiguous common paths are necessary: one for the magnetic male die members transporting the straight cut lengths of wire; one for the female shaping die members co-acting with the male die members to form the staples and acting as staple-inserting elements to eject and pass the staples through the signatures; and one for clenching male dies acting as the staple-clenching elements. Furthermore, the formed staples are carried and inserted solely in the direction extending in the direction of travel of the signatures.

A simplified construction of the chain drive system of the prior art stitcher as previously explained is disclosed in U.S. Pat. No. 4,792,077. In this known apparatus for applying staples to groups of signatures only two cyclically revolving paths are provided. The two chain link assemblies of these revolving paths have a common contiguous transit path portion which is defined by respective synchronously driven chaindrive sprocket wheel sets. Measured lengths of wire provided by a wire cutter-transfer assembly are supplied to special stapler links carried on one chain link assembly. With this arrangement, the wire feed can be phased to space staples a predetermined number of chain links apart in order to provide staples where desired in a given signature or like paper product. Incoming signatures to be stapled are transferred from an incoming conveyor belt and are grasped between the two sets of links in the respective chains as they contiguously meet. The two revolving chain paths thus assume the double function of inserting the formed staples and conveying the signatures along the contiguous pathway to be discharged onto a suitable conveyor for further transit.

Since the signatures to be staled are delivered with their creases or crease lines aligned with the movement of the links and further conveyed by the cyclically driven chains, the insertion of the staples is accomplished along the respective creases or crease lines in the lengthwise direction of the signatures or like paper products. If a signature is to be provided with two staples, the insertion of the two staples for one signature will be sequentially effected, i.e. one staple after the other.

SUMMARY OF THE INVENTION

Therefore, with the foregoing in mind, it is a primary object of the present invention to provide a new and improved construction of apparatus and method for stapling multipart printed products which does not exhibit the aforementioned drawbacks and shortcomings of prior art constructions.

Another and more specific object of the present invention is to provide a new and improved apparatus and method for stapling multipart printed products, which apparatus is simple in construction and design and renders possible accurate and reliable stapling of printed products along their creases or crease lines which extend transversely or at right angles with respect to the direction of forward travel of the printed products to be stapled, whereby the latter can be incoming as individual products as well as in a contiguously joined formation as a multilayered continuous web.

In keeping with the immediately preceding object, it is a further object of the present invention to provide a new and improved construction of a stapling apparatus which is particularly suitable for use in the folded-product delivery of a rotary printing press or machine.

Now in order to implement these and other objects of the invention, which will become more readily apparent in the description which follows, the apparatus of the present invention comprises a conveying arrangement, a stapling-head arrangement, a staple-closing arrangement, and a wire-length dispenser unit.

The conveying arrangement has a predetermined conveying direction and serves to convey the multipart printed products along a travel path and through a stapling zone or area. The multipart printed products to be stapled have crease lines which extend substantially at right angles to the conveying direction. The stapling-head arrangement includes a plurality of stapling heads for inserting staples along the crease lines. The stapling heads revolve along a first closed revolving path substantially at the travel speed of the multipart printed products and are successively or tandemly arranged in a predetermined spaced relationship in the revolving direction of the first closed revolving path. The first closed revolving path in the stapling zone or area extends along a first section or portion substantially parallel to the travel path of the printed products. The staple-closing arrangement includes a plurality of countersupports provided to co-act in the stapling zone or area with the plurality of stapling head, the countersupports each have closing means for closing staples inserted by the respective stapling heads. The countersupports revolve synchronously with respect to the travel path of the printed products. The wire-length dispenser unit is stationarily arranged at the first closed revolving path of the plurality of stapling heads. Each stapling head traveling past in the revolving direction of the first closed revolving path takes over a wire length or piece at the wire-length dispenser.

In a preferred embodiment, the wire-length dispenser unit is advantageously arranged outside of the stapling zone or area.

In another preferred embodiment stapling-head arrangement is appropriately disposed in a manner such that it is separated from the conveying arrangement.

BRIEF DESCRIPTION OF THE DRAWINGS

The invention will be better understood and objects other than those set forth above will become apparent when consideration is given to the following detailed description including the drawings. In these drawings, the same reference characters have been used to denote the same or analogous components.

DETAILED DESCRIPTION OF THE PREFERRED EMBODIMENTS

Referring now the drawings, it is to be understood that to simplify the showing thereof, only enough of the construction of the exemplary embodiments of apparatus for stapling multipart printed products has been illustrated therein as is needed to enable one skilled in the art to readily understand the underlying principles and concepts of this invention.

Figure 1:
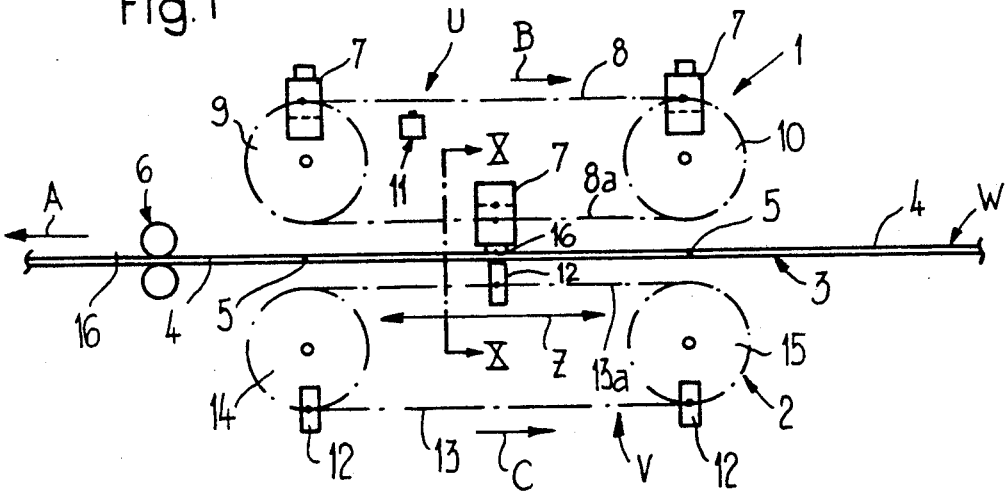
FIG. 1 schematically shows, in a side view, a first exemplary embodiment of the apparatus for stapling multilayered webs and constructed according to the invention.
Figure 2:
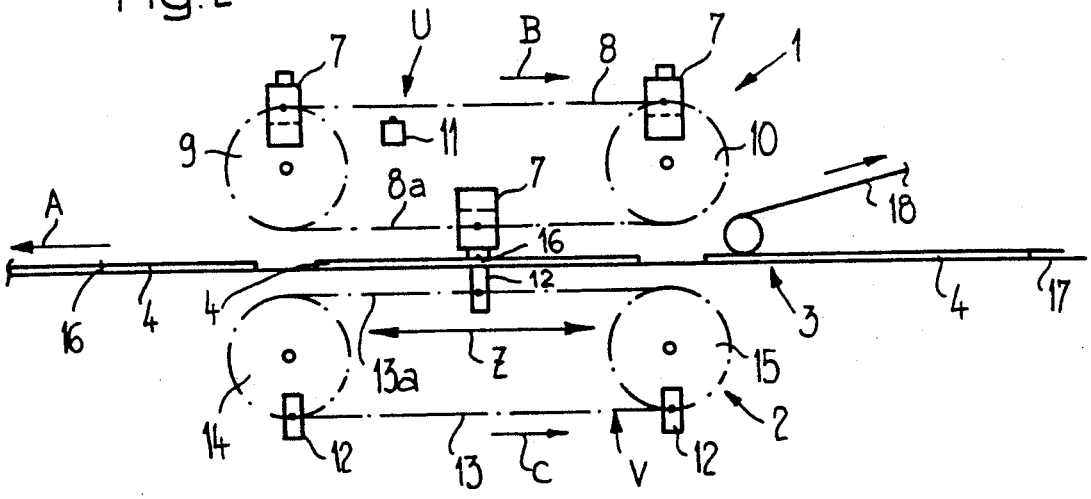
FIG. 2 schematically shows, in a side view, the first exemplary embodiment of the apparatus according to FIG. 1, but structured to process individual printed products.

Turning attention now specifically to FIGS. 1 and 2 of the drawings, the apparatus schematically illustrated therein by way of example and not limitation will be seen to represent two variants of a first exemplary embodiment of a stapler or stapling apparatus constructed according to the invention. The variant according to FIG. 1 serves to staple printed products supplied or infed in the form of a continuous web, while the variant according to FIG. 2 is provided for stapling individually supplied products.

Both variants have a stapling-head arrangement 1 and a staple-closing arrangement 2 which co-act with each other. Between the stapling, a linear travel path of multipart printed products 4 to be stapled (for instance newspapers, magazines, brochures and the like) extends between the stapling-head arrangement and the staple closing arrangement 2. In the variant according to FIG. 1, the individual/printed products are part of a web W and which, after stapling is accomplished, are separated from each other along cutting lines or marks 5. In the variant according to FIG. 2, the printed products 4 are individually guided along the linear travel path 3 extending between the stapling-head arrangement 1 and the staple-closing arrangement 2.

In order to convey the web W depicted in FIG. 1 in the conveying direction indicated by arrow A, there is provided a conveying arrangement 6 which is illustrated in FIG. 1 as a pair of conveyor rolls or rollers.

The stapling-head arrangement 1 comprises stapling-heads 7 mounted at an endless chain 8 and arranged to assume or retain a predetermined mutual spacing. This endless chain 8 is guided around two deflection wheels 9 and 10 and revolvingly driven in the direction of arrow B. The endless chain 8 has a run 8*a* which faces the linear travel path 3 of the printed products 4 and extends substantially parallel to the conveying direction A of the web W. In other words, a revolving path U of the stapling-heads 7 comprises a section extending substantially parallel to the linear travel path 3 of the printed products 4. A wire-length dispenser unit 11 common to all stapling-heads 7 is arranged within this revolving path U of the stapling-heads 7. This wire-length dispenser unit 11 is arranged at the revolving path U and turns over a straight piece or length of wire to each stapling-head 7 passing by in the direction of the arrow B. Such straight piece or length of wire is bent to form a substantially U-shaped staple during subsequent further travel of the respective stapling-head 7, as will be described below in greater detail.

The staple-closing arrangement 2 arranged below the linear travel path 3 of the printed products 4 comprises a number of countersupports 12. These countersupports 12 are provided with a closing or clenching arrangement for bending the staple legs or ends penetrating respective printed products 4 (not shown). The countersupports 12 are likewise mounted on an endless chain 13 which is guided around deflection wheels 14 and 15 and revolvingly driven in the direction of arrow C. The endless chain 13 possesses a run 13*a* facing the linear travel path 3 of the printed products 4 and extending substantially parallel to this linear travel path 3. A revolving path V defined by the countersupports 12 thus also includes a section extending substantially parallel to the linear travel path 3 of the printed products 4.

The stapling-heads 7 and the countersupports 12 are arranged such that, in a stapling zone or area designated by reference character Z, a stapling-head 7 mates each time with a respective countersupport 12. With this arrangement, the revolving speed of the stapling-heads 7 and of the countersupports 12 corresponds with the travel speed of the web W.

In the stapling zone or area Z the staple shaped or formed in the respective stapling-head 7, as mentioned above, is pressed into the multilayered printed product 4 to be stapled, whereby the legs or ends of the staple are bent or turned down by the on-line traveling countersupport 12. Since the stapling-heads 7 and the countersupports 12 move synchronously with the printed products 4 during stapling, a certain length of time is available for the stapling operation. Faultless stapling is thus rendered possible.

The staples are inserted in the direction of already existing crease lines 16 or of subsequently provided crease lines, whereby such crease lines 16 extend substantially at right angles to the conveying direction A of the printed products 4. Normally at least two staples are inserted along such crease lines 16. To accomplish this, a second stapling-head arrangement 1' and a second staple-closing arrangement 2' of the type depicted in FIG. 1 are provided. However, since FIG. 1 shows the stapling apparatus solely in a side view, the second stapling-head arrangement 1' and the second staple-closing arrangement 2' are not visible in FIG. 1.

A preferred construction of the stapling-head arrangements 1 and 1' and of the staple-closing arrangements 2 and 2' will be described below in conjunction with FIGS. 10 through 17.

The variant of the first exemplary embodiment of the apparatus for stapling individual products 4 and depicted in FIG. 2 differs from the variant according to FIG. 1 only in that a band or belt conveyor 17 is provided for infeeding the multipart individual products 4. Above this band or belt conveyor 17 there is provided a conveying or feed belt 18 located upstream of the stapling zone or area Z, as viewed in the conveying direction A of the individual printed products 4. This conveying or feed belt 18 bears upon the upper side or surface of the individual printed products 4. In this variant according to FIG. 2, the stapling operation is accomplished in the same manner as described above with respect to the variant according to FIG. 1.

Figure 3:
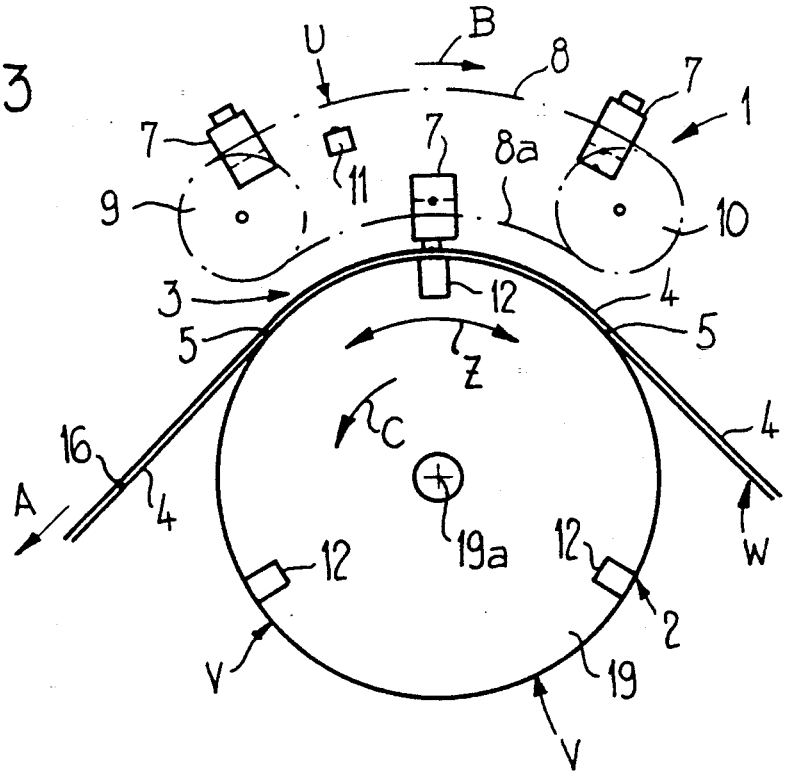
FIG. 3 schematically shows, in a side view, a second exemplary embodiment of the apparatus for stapling multilayered webs and constructed according to the invention.
Figure 4:
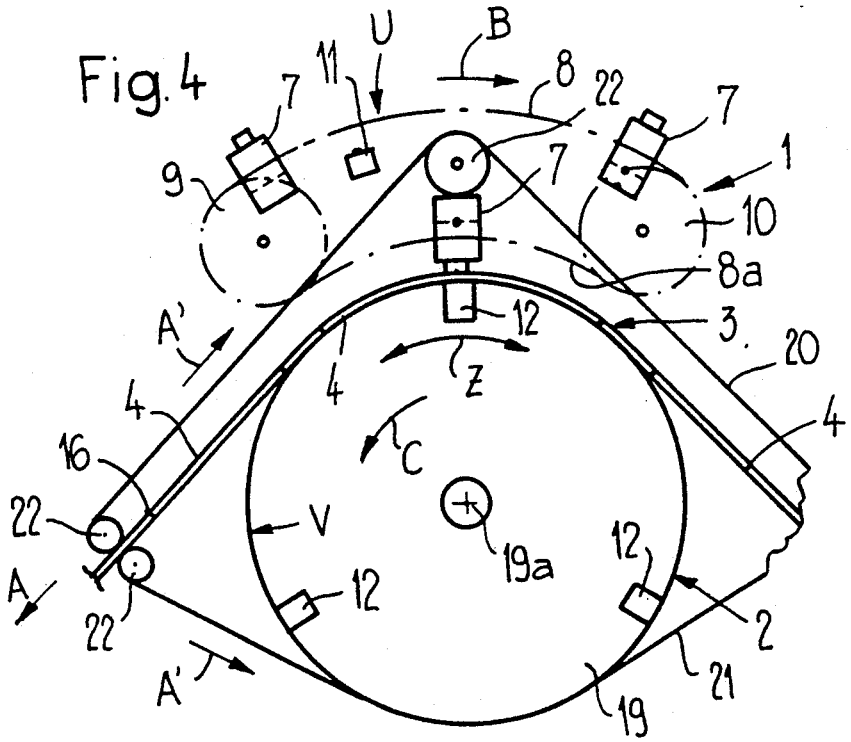
FIG. 4 schematically shows, in a side view, the second exemplary embodiment of the apparatus according to FIG. 3, but structured to process individual products.

A second exemplary embodiment of the stapling apparatus constructed according to the invention and depicted in FIGS. 3 and 4 differs from the first exemplary embodiment of the stapling apparatus according to FIGS. 1 and 2 in that the staple-closing arrangements 2 and 2' are of a different construction, The staple-closing arrangement 2' is not visible in the illustration of FIGS. 3 and 4.

In FIGS. 3 and 4 the countersupports 12 are provided with suitable closing or clenching arrangements. The countersupports 12 are arranged at the circumference of a cylinder or rotor 19 rotatingly driven in the direction of the arrow C. The web W is depicted in FIG. 3 and the individual printed products 4 depicted in FIG. 4 are guided around the cylinder or rotor 19 along an arcuate travel path 3. The endless chain 8 carrying the stapling-heads 7 is guided in a not particularly illustrated manner such that the run 8*a* facing the arcuate travel path 3 of the multilayered web W (FIG. 3) and of the individual printed products 4 (FIG. 4) extends in a substantially curved or arched manner. Thus the respective section of the revolving path U of the stapling-heads 7 in the stapling zone or area Z again extends substantially parallel to the arcuate travel path 3 of the printed products 4, i.e. substantially coaxial with respect to the axis of rotation 19*a* of the rotatingly driven cylinder or rotor 19. The stapling-heads 7 thus move along an approximately reniform revolving path U, while the revolving path V of the countersupports 12 is a circular path or orbit.

Stapling in the zone or area Z shown in FIGS. 3 and 4 is accomplished substantially in the manner described above in conjunction with FIGS. 1 and 2. The apparatus for stapling individual printed products 4 and illustrated in FIG. 4 differs from the apparatus for stapling webs W and illustrated in FIG. 3 in that conveying belts 20 and 21 are provided for guiding the oncoming individual printed products 4. These two conveying belts 20 and 21 are conducted around deflection rolls or rollers 22 and over the cylinder or rotor 19. The individual printed products 4 are held by the conveying belts 20 and 21 revolving in the direction of arrow A' and conveyed along the arcuate travel path 3 in the conveying direction indicated by the arrow A.

The second exemplary embodiment of the apparatus constructed according to the invention and illustrated in FIGS. 3 and 4 is also provided with at least two identical stapling-head arrangements 1 and 1' and at least two identical staple-closing arrangements 2 and 2'. The countersupports 12 of both staple-closing arrangements 2 and 2' can thereby be arranged at the time same cylinder or rotor 19.

Figure 5:
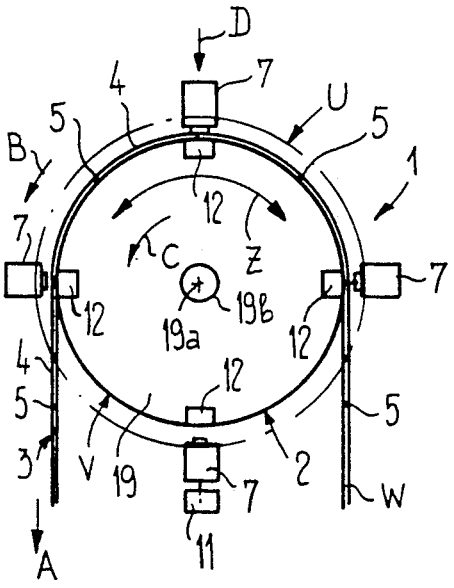
FIG. 5 schematically shows, in a side view, a third exemplary embodiment of the apparatus for stapling multilayered webs and constructed according to the invention.
Figure 6:
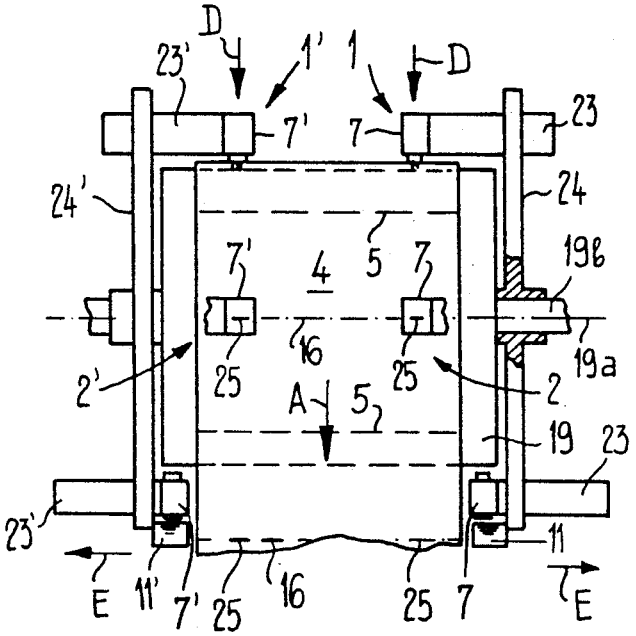
FIG. 6 schematically shows, in a front view, the third exemplary embodiment of the apparatus according to FIG. 5.
Figure 7:
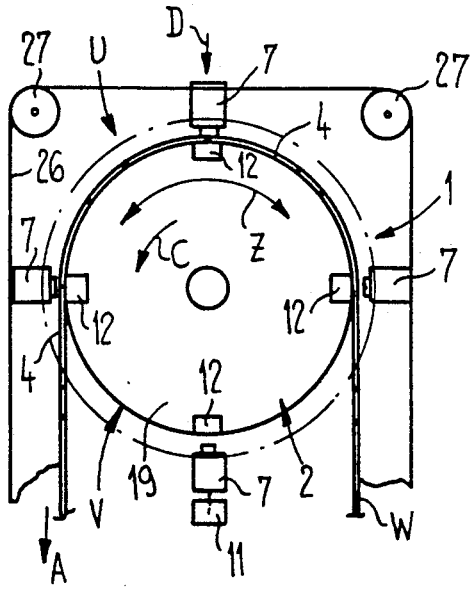
FIG. 7 schematically shows, in illustration comparable to that in FIG. 5, the third exemplary embodiment of the apparatus according to FIG. 5, but structured to process individual products.
Figure 8:
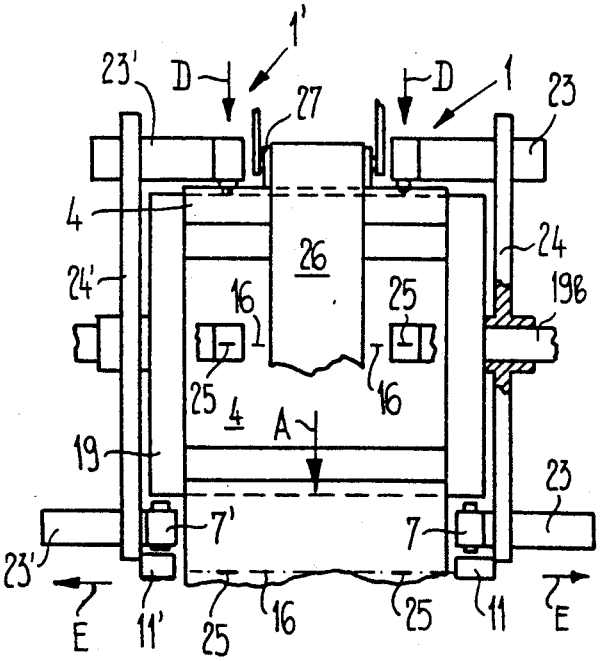
FIG. 8 schematically shows, in an illustration comparable to that in FIG. 6, the third exemplary embodiment of the apparatus according to FIG. 7.

A third exemplary embodiment of the apparatus constructed according to the invention is depicted in FIGS. 5 and 6 as well as in FIGS. 7 and 8. The variant according to FIGS. 5 and 6 processes continuous webs W formed of printed products 4 to be stapled, while the variant according to FIGS. 7 and 8 serves to staple individually conveyed printed products 4. Otherwise, these two variants of the third exemplary embodiment of the apparatus according to FIGS. 5 and 6 and FIGS. 7 and 8, respectively, are substantially of the same construction and design.

In each of the variants according to FIGS. 5 and 6 and FIGS. 7 and 8, respectively, there are provided two stapling-head arrangements 1 and 1' as well as two staple-closing arrangements 2 and 2', which are arranged in spaced relationship to one another in a direction extending transverse to the conveying direction A of the web W formed of adjacently joined printed products 4 (FIGS. 5 and 6) and of the individually conveyed printed products 4 (FIGS. 7 and 8). The spaced relationship of the stapling-head arrangements 1 and 1' and of the staple-closing arrangements 2 and 2' is depicted in the front views of FIGS. 6 and 8. The staple-closing arrangements 2 and 2' are thereby structured in the same manner as those of the second exemplary embodiment of the apparatus according to FIGS. 3 and 4. The countersupports 12 as well as countersupports 12' of the staple-closing arrangement 2' are mounted at the cylinder or rotor 19 rotatingly driven in the direction of the arrow C and, accordingly, move along the revolving path V defining a circular path. The countersupports 12' are not visible in the showing of FIGS. 5 through 8.

However, the stapling-head arrangements 1 and 1' differ from those shown in the second exemplary embodiment of the stapling apparatus according to FIGS. 3 and 4. The stapling heads 7 as well as stapling heads 7' of the second stapling-head arrangement 1' are moved along respective revolving paths 1 which extend around the cylinder or rotor 19. The section of each revolving path U located in the stapling zone or area Z is thereby coaxially arranged with respect to the axis of rotation 19*a* of the cylinder or rotor 19.

As illustrated in FIGS. 6 and 8, the stapling heads 7 and 7' are secured at respective support arms 23 and 23' which are displaceably mounted in respective carriers 24 and 24'. These carriers 24 and 24' are seated at a shaft 19*b* of the cylinder or rotor 19 in a manner such as to be non-rotatable relative to the shaft 19*b*. In other words, the carriers 24 and 24' rotate synchronously with the cylinder or rotor 19.

During the stapling operation, i.e. in the stapling zone or area Z, the support arms 23 and 23' are located in their respective lead-in position, in which the stapling heads 7 and 7' lie opposite or face respective countersupports 12 and 12'. In this working or operating position of the stapling heads 7 and 7' (depicted in FIGS. 6 and 8), the stapling heads 7 and 7' are moved in the direction of arrows D in order to carry out the stapling operation, for instance by means of suitable control levers or cams. After leaving the stapling zone or area Z, the stapling heads 7 and 7' secured at the support arms 23 and 23' are again raised or lifted off. Furthermore, the support arms 23 and 23' are retracted in the direction of arrows E, so that the stapling heads 7 and 7' are returned to a position in which they are located beyond the travel path 3 of the stapled printed products 4 forming web W (FIGS. 5 and 6) and of the stapled individual printed products 4 (FIGS. 7 and 8), and thus do not impair discharge of the stapled printed products 4 from the cylinder or rotor 19. The stapling heads 7 and 7' located in this retracted position of the support arms 23 and 23' are carried past respective wire-length metering and dispenser units 11 and 11' which dispense a straight piece or length of wire to each stapling head 7 and each stapling head 7', respectively, traveling along respective revolving paths U. Such straight piece or length of wire is then bent or shaped during further travel of the respective stapling heads 7 and 7' to form a substantially U-shaped staple, as above described with respect to the apparatus according to FIG. 1. Otherwise, stapling is effected in the very same manner as in the first and second exemplary embodiments of the apparatus shown in FIGS. 1 and 2 and FIGS. 3 and 4, respectively. Already inserted and closed staples of processed portions of web W (FIG. 6) or of processed individual printed products 4 (FIG. 8) have been designated by reference numeral 25 in FIGS. 6 and 8.

In the variant of the apparatus for stapling individual printed products 4 and depicted in FIGS. 7 and 8, there is provided an endless holding belt or band 26 which wraps around the rotatingly driven cylinder or rotor 19, is guided around deflection rolls or rollers 27, and guides the individually supplied or infed printed products 4 around the cylinder or rotor 19.

Figure 9:
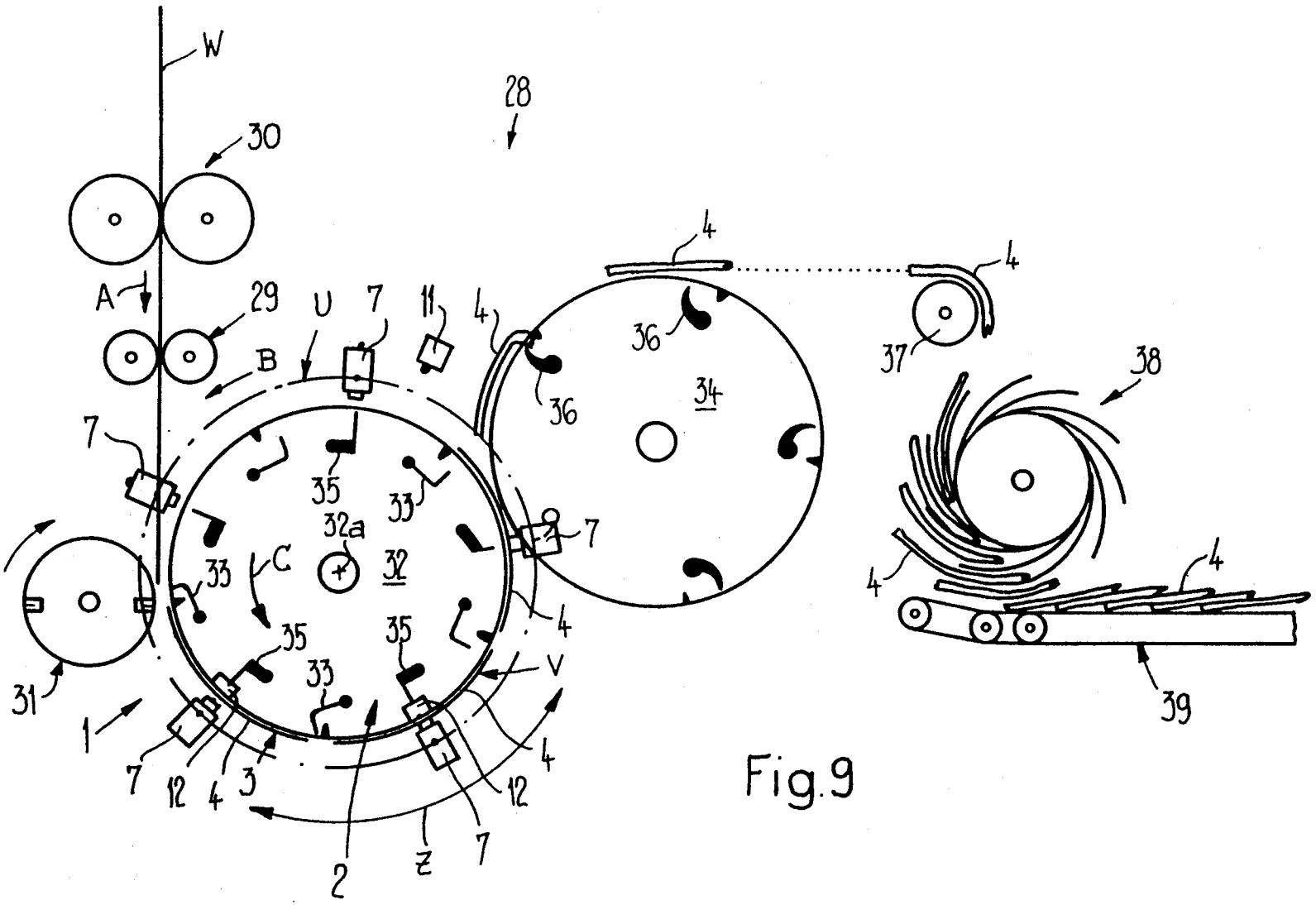
FIG. 9 schematically shows, in a side view, the folded-product delivery of a rotary printing press or machine provided with a stapling apparatus constructed according to the invention.

FIG. 9 very schematically illustrates a folded-product delivery 28 of a not particularly illustrated rotary printing press or machine. Such a delivery 28 being equipped with a stapling apparatus constructed according to the invention. The folded-product delivery 28 is of known and conventional structure and design, so that the folder or folder unit of the folded-product delivery 28 will be only briefly described below.

The folded web W formed of contiguously joined printed products 4 is guided or passed between two perforating rollers 30 by means of a pair of draw rollers 29. These two perforating rollers 30 provide a cross or transverse perforation at the web W. The web W then travels between a knife or cutting cylinder 31 and a collecting cylinder 32 and is thereby cut or severed in the cross direction. The cut and thus isolated printed products 4 are held or secured by holding devices 33, such as needle or gripper systems, arranged in the collecting cylinder 32. The individual printed products 4 which are supported at the circumference of the collecting cylinder 32 are then turned over to a folding-jaw cylinder 34 and thus folded once again. A folding blade or knife 35 provided at the collecting cylinder 32 thereby co-operates in each case with a folding jaw 36 which forms part of the folding-jaw cylinder 34. The folded individual printed products 4 are conveyed from the folding-jaw cylinder 34 by means of a deflection wheel 37 into the compartments of a feeder wheel 38, which deposits the individual printed products 4 in an imbricated or shingled formation upon a delivery or feeder band or belt 39.

So far, the folded-product delivery 28 described above is, as mentioned, of conventional structure and design. This folded-product delivery 28 is now equipped with an apparatus for stapling multipart printed products 4 and constructed in accordance with the teachings of the present invention, which apparatus essentially corresponds with the third exemplary embodiment depicted in FIGS. 7 and 8. It is to be understood that components or associated parts related to the second stapling-head arrangement 1' and the second staple-closing arrangement 2' are not visible in FIG. 9, but the reference numerals and characters thereof are informatively included in the following description of the stapling apparatus depicted in FIG. 9.

The staple-closing arrangements 2 and 2' are appropriately integrated in the collecting cylinder 32. The countersupports 12 and 12' are preferably located in the range or region of the folding blades or knives 35 and travel along the revolving or circular path V. The countersupports can be, for example, statically acting clinching dies as disclosed, for example, in British Patent No. 740,079, published Nov. 9, 1955. On the other hand, it is also conceivable to provide the countersupports 12 and 12' with controlled clinching dies as will be described below in conjunction with FIG. 10.

The stapling heads 7 and 7' of the respective stapling-head arrangements 1 and 1' revolve, synchronously with the collecting cylinder 32 and the countersupports 12 and 12', along respective revolving paths U which coaxially extend around the collecting cylinder 32. At these revolving paths U there are arranged, as previously described in conjunction with FIGS. 1 through 8, the wire-length dispenser units 11 and 11' at which the stapling heads 7 and 7' travel by, each of which picking up a straight piece or length of wire. In the course of further travel of the stapling heads 7 and 7' to the stapling zone or area Z, the entrained pieces or lengths of wire are deformed or bent to appropriately form substantially U-shaped staples. As explained above with respect to FIGS. 6 and 8, the stapling heads 7 and 7' are displaceable in the direction of axis 32*a* of the collecting cylinder 32. Within the stapling zone or area Z, the stapling heads 7 and 7' are in their lead-in position, in which they face respective countersupports 12 and 12'.

Upon leaving the stapling zone or area Z, the stapling heads 7 and 7' are retracted into their outer and position or end of travel, in which they are located beyond the travel path 3 of the printed products 4.

Stapling is effected in the stapling zone Z in the manner previously described in conjunction with FIG. 1. Since in the stapling zone Z the stapling heads 7 and 7' and the associated countersupports 12 and 12' are synchronously on-line with the respective printed products 4 to be stapled, there is appreciably more time available for the stapling operation than is the case in prior art stapling mechanisms as disclosed, for example, in the aforementioned British Patent No. 740,079 and in U.S. Pat. No. 4,750,661, granted Jun. 14, 1988.

It is to be remarked that, as previously described with respect to FIGS. 7 and 8, there are provided two or more identical stapling-head arrangements 1 and 1' with associated staple-closing arrangements 2 and 2', in the order to insert and close two or more staples in the direction of the crease line 16 of the individual printed products 4.

If the collecting cylinder 32 performs or carries out two revolutions to collect the printed products 4 before the printed products 4 are transferred to the folding-jaw cylinder 34, the stapling heads 7 and 7' are, accordingly, controlled or governed such that they are ineffective during the first revolution.

As a variant to the apparatus for stapling individual printed products 4 subsequent to cutting the web W and illustrated in FIG. 9, it is also practicable to process the web W, in the manner described in conjunction with FIG. 1, FIG. 3 and FIGS. 5 and 6, prior to cutting or severing the web W, so that stapling is accomplished upstream of the knife or cutting cylinder 31, as viewed in the direction of the travel path 3. In other words, an apparatus for stapling continuous webs W as depicted, for example, in FIG. 1, FIG. 3 or FIGS. 5 and 6, would then be arranged upstream of the knife or cutting cylinder 31 and the collecting cylinder 32, as viewed in the direction of web travel path 3.

In a further practicable variant with respect to the embodiment depicted in the folded-product delivery 28 according to FIG. 9, an apparatus for stapling individual printed products 4 according to FIG. 2, FIG. 4, or FIGS. 7 and 8 is arranged downstream of the collecting cylinder 32 and upstream of the folding-jaw cylinder 34, as viewed in the direction of travel path 3. The individual printed products 4 are thereby detached from the collecting cylinder 32, guided through the stapling apparatus and folded after the stapling operation.

A practicable structural design of the apparatus for stapling printed products 4 and particularly of the stapling heads 7 and 7' and of the associated staple-closing arrangements 2 and 2' will be now described with respect to FIGS. 10 through 17 and in conjunction with FIG. 1. This construction of the apparatus for stapling multipart printed products is obviously also applicable—with some modification—in any other of the illustrated exemplary embodiments.

Figure 10:
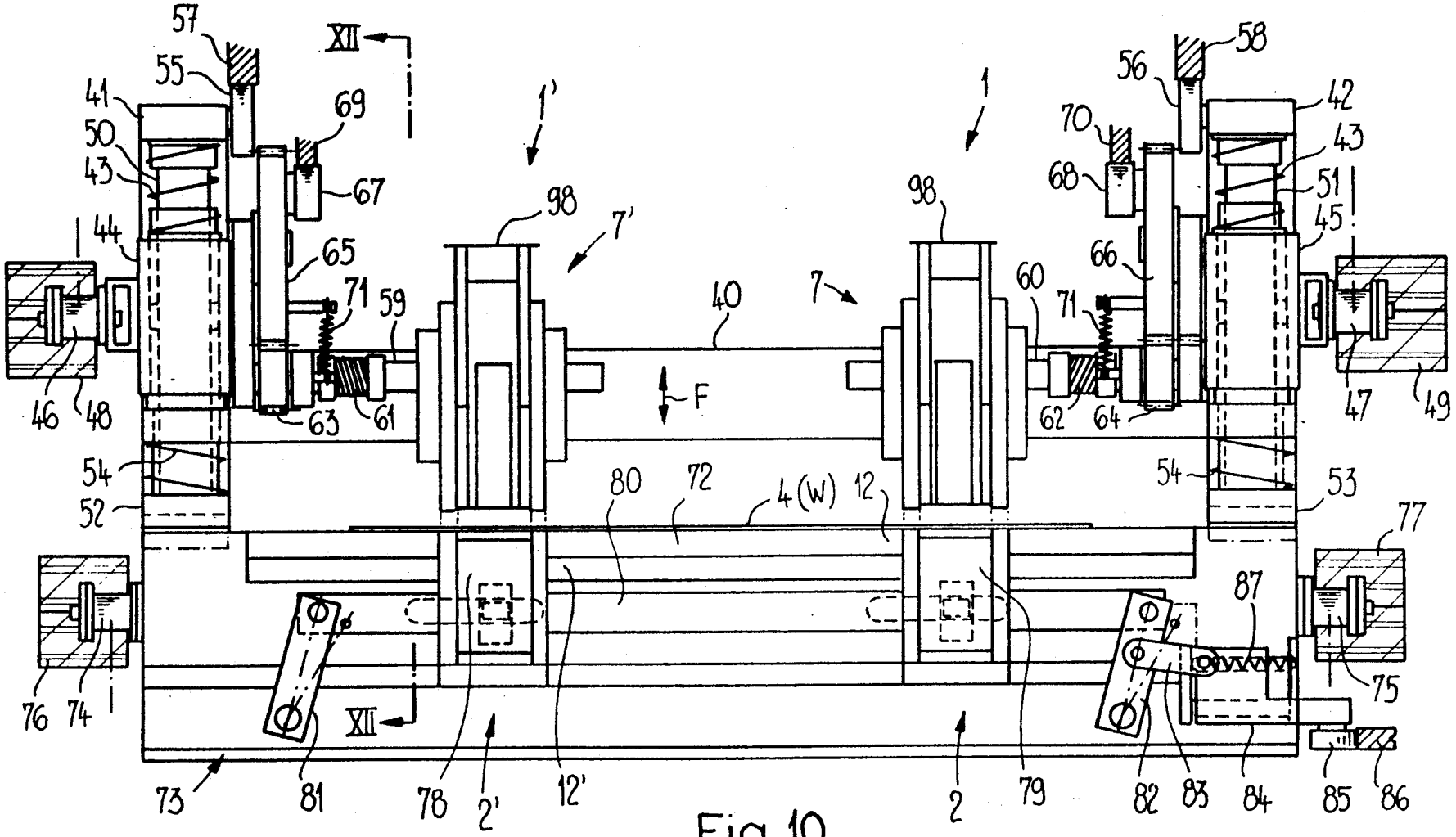
FIG. 10 schematically shows, in a sectional view taken substantially along the line X—X in FIG. 1, a preferred structural construction of the apparatus for stapling multipart printed products and constructed according to the invention.
Figure 11:
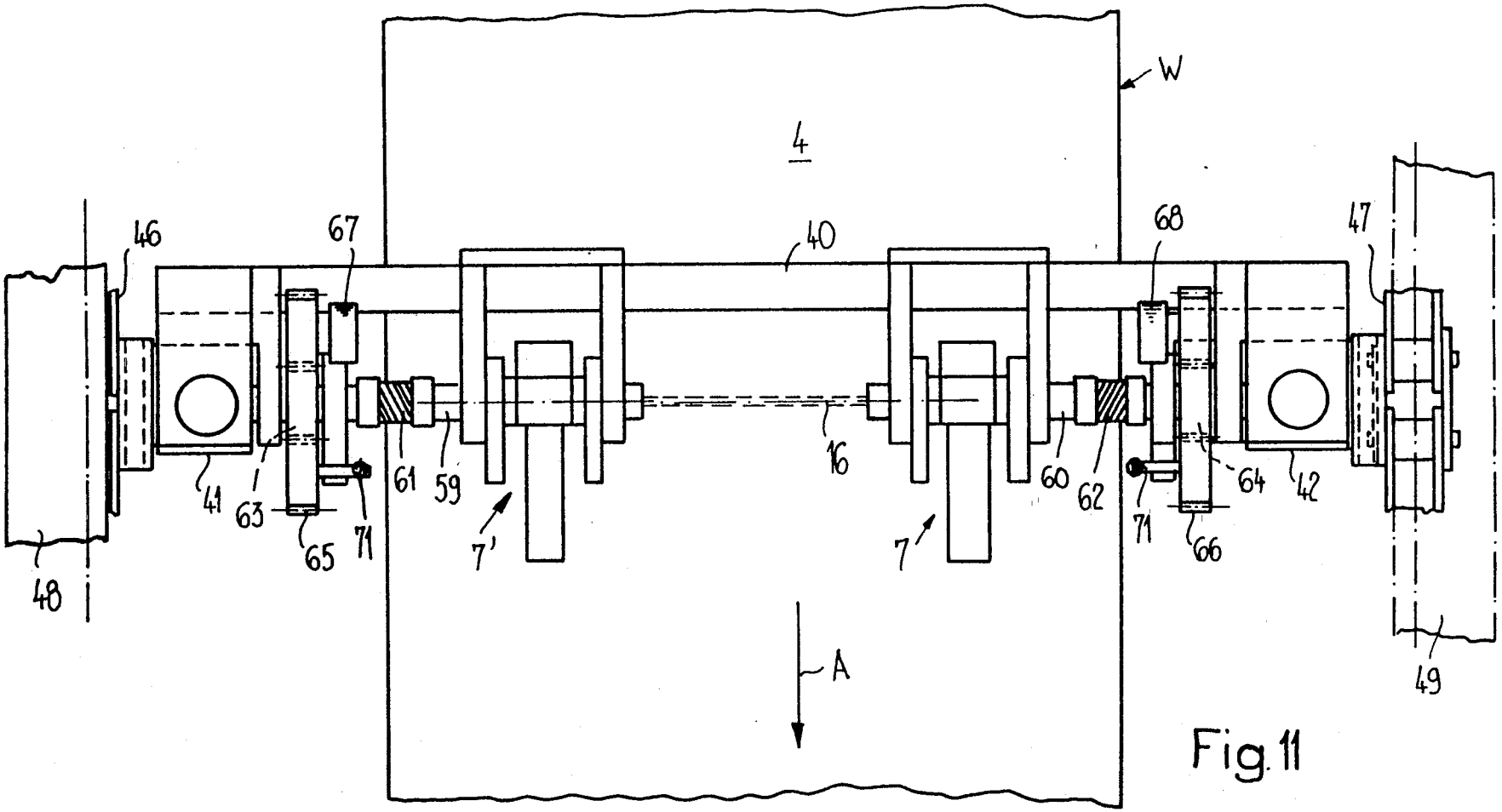
FIG. 11 schematically shows, in a top plan view, the apparatus according to FIG. 10.

Referring now to FIGS. 10 and 11, the apparatus for stapling printed products which includes the two stapling heads 7 and 7' is illustrated there in a sectional view taken substantially along the line X—X in FIG. 1 and in a top plan view, respectively. It will be seen that the two stapling heads 7 and 7' are mounted at a suitable transverse bar or beam 40 which can be respectively lifted or lowered in the direction of the double-headed arrow F and which is supported at each end thereof at a readjusting or restoring spring 43 by means of respective supporting members 41 and 42. The two readjusting or restoring springs 43 rest upon respective guide bushes 44 and 45 appropriately anchored at respective chains 46 and 47 which are guided in respective guideways 48 and 49. The guide bushes 44 and 45 are provided with respective through bolts or pins 50 and 51 which, at one end thereof, co-act with the associated supporting members 41 and 42 and which, at the other end thereof, carry respective centering elements 52 and 53, each of the latter being supported at a further spring 54.

The two supporting members 41 and 42 are provided at their upper end with respective control rolls or rollers 55 and 56 which co-operate with respective control cams 57 and 58. The moved portion of each stapling head 7' and the moved portion of each stapling head 7 are seated at respective shafts 59 and 60. The shafts 59 and 60 are connected with respective toothed wheels or gears 63 and 64 by means of respective overload couplings 61 and 62, whereby these toothed wheels or gears 63 and 64 mesh with respective further toothed wheels or gears 65 and 66 rotatably mounted at the supporting members 41 and 42, respectively. At these further toothed wheels or gears 65 and 66, there are mounted respective control rolls or rollers 67 and 68 provided for co-action with further suitable cams 69 and 70, respectively. Further readjusting or restoring springs 71 act at one end thereof upon the toothed wheels or gears 65 and 66 and, at the other end thereof, are connected to the supporting members 41 and 42, respectively.

The countersupports 12 and 12' are appropriately formed by a common bearing rail 72 or equivalent structure mounted by means of supporting members 73 at chains 74 and 75 which travel in guideways 76 and 77, respectively. The staple-closing arrangements 2' and 2 comprise displaceably mounted staple-closing dies 78 and 79, respectively, provided in the countersupports 12' and 12, i.e. in the bearing rail 72. These staple-closing dies 78 and 79 depicted in FIG. 10 can be lifted toward the respective stapling heads 7' and 7 by means of a suitable actuating member 80. This actuating member 80 is mounted at both ends thereof at respective pivot levers 81 and 82. A link or connection piece 83 connected to an actuating ever 84 acts upon the pivot lever 82. The actuating lever 84 carries at its one end a control roll or roller 85 which co-operates with a cam 86. A further readjusting or restoring spring 87 acts upon the link or connection piece 83.

Figure 12:
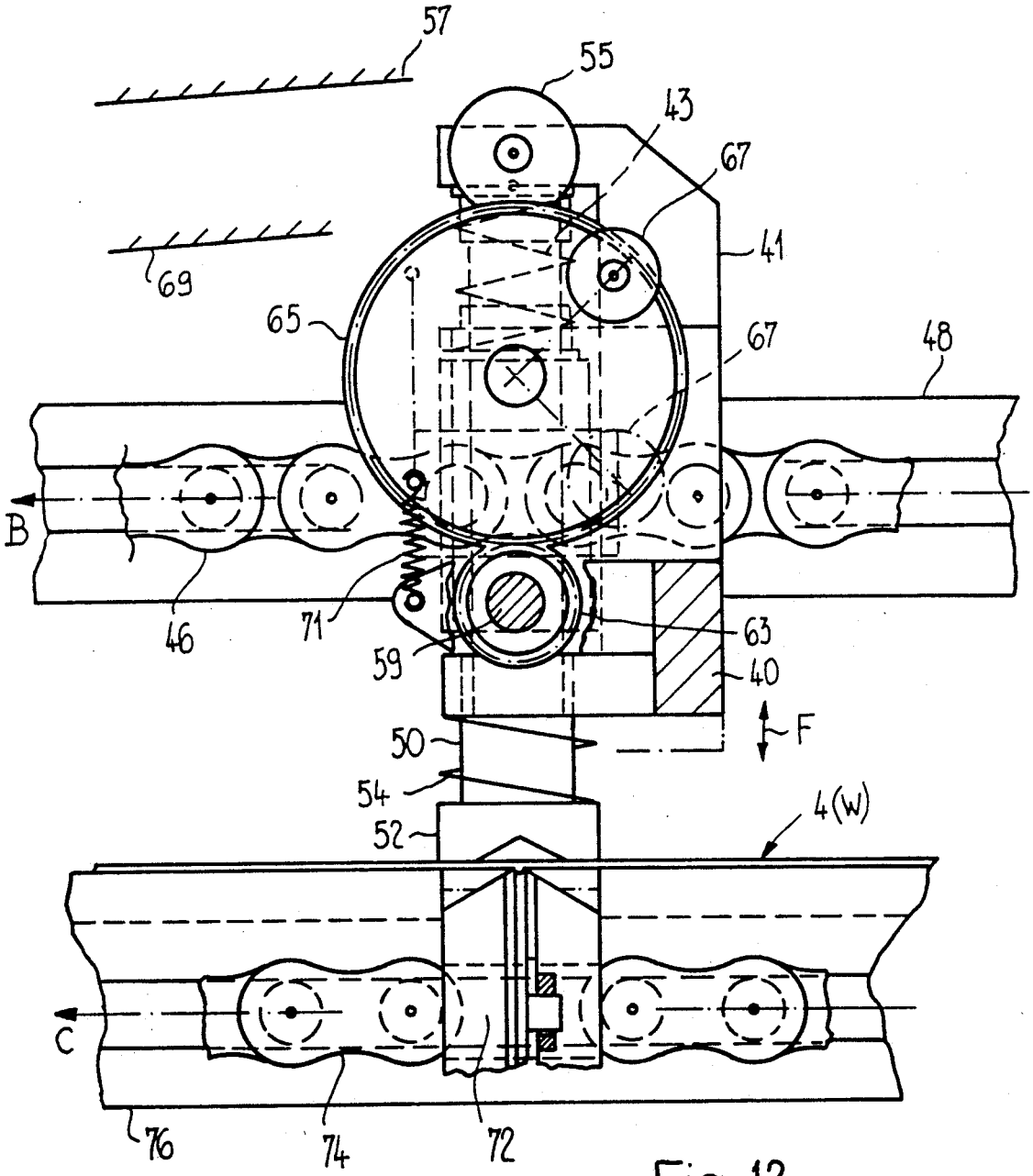
FIG. 12 schematically shows a cross-section taken substantially along the line XII—XII in FIG. 10.

Having now had the benefit of the foregoing description of the apparatus for stapling multipart printed products as considered with respect to FIGS. 10 and 11, its mode of operation will be now explained in conjunction with FIGS. 10 through 12.

As soon as the control rolls or rollers 55 and 56 respectively enter or engage the control cams 57 and 58 arranged in the stapling zone or area Z, the transverse bar or beam 40 is lowered together with the stapling heads 7 and 7' in the downward direction of the double-headed arrow F to the synchronously on-line bearing rail 72. The centering elements 52 and 53 thereby engage the corresponding centering sections of the bearing rail 72, the centering operation of the stapling heads 7 and 7' and the countersupports 12 and 12' thus being accomplished. In the course of further travel of the transverse bar or beam 40 in the direction of the arrow B (FIG. 12), the cams 69 and 70 come to act upon the control rolls or rollers 67 and 68. This results in the rotation of the shafts 59 and 60 effected via the toothed wheels or gears 63, 65 and 64, 66, respectively. The purpose of this rotation of the shafts 59 and 60 will be explained below with respect to FIGS. 13 through 17.

In the course of further travel or passage through the stapling zone or area Z by the stapling heads 7 and 7' and the countersupports 12 and 12', the staple-closing dies 78 and 79 are lifted subsequent to the insertion of staples into the respective printed product 4, whereby the ends or legs of the substantially U-shaped staples are bent in known manner to firmly secure the staples in the printed product 4. Lifting or raising the staple-closing dies 78 and 79 is accomplished by the control roll or roller 85 entering or engaging the cam 86. This results in pivotal movement of the pivot levers 81 and 82 in counter-clockwise direction, as viewed in FIG. 10, thereby lifting the actuating member 80.

After terminating the stapling operation, the control rolls or rollers 55 and 56, 67 and 68, as well as 85, exit from the respective cams 57 and 58, 69 and 70, and 86. This results in a readjustment by means of the readjustment or restoring springs 43, 71 and 87.

The construction of the stapling heads 7 and 7' will be now explained in conjunction with FIGS. 13 through 17 and with respect to the stapling head 7'. With respect to FIGS. 15, 16 and 17, only those components or parts have been provided with reference characters and numerals, which are of importance in connection with the respective functional description. Moreover, the construction and mode of operation of the stapling heads 7 and 7' are described in greater detail in Swiss Patent Application No. 01,963/89.

Figure 14:
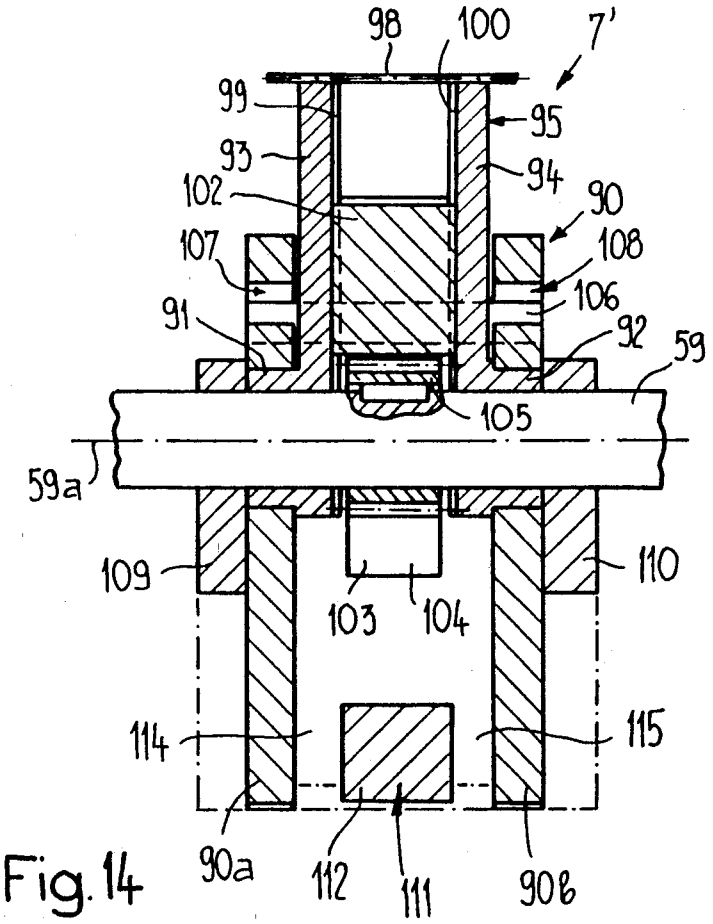
FIG. 14 schematically shows a cross-section taken substantially along the line XIV—XIV in FIG. 13.
Figure 13:
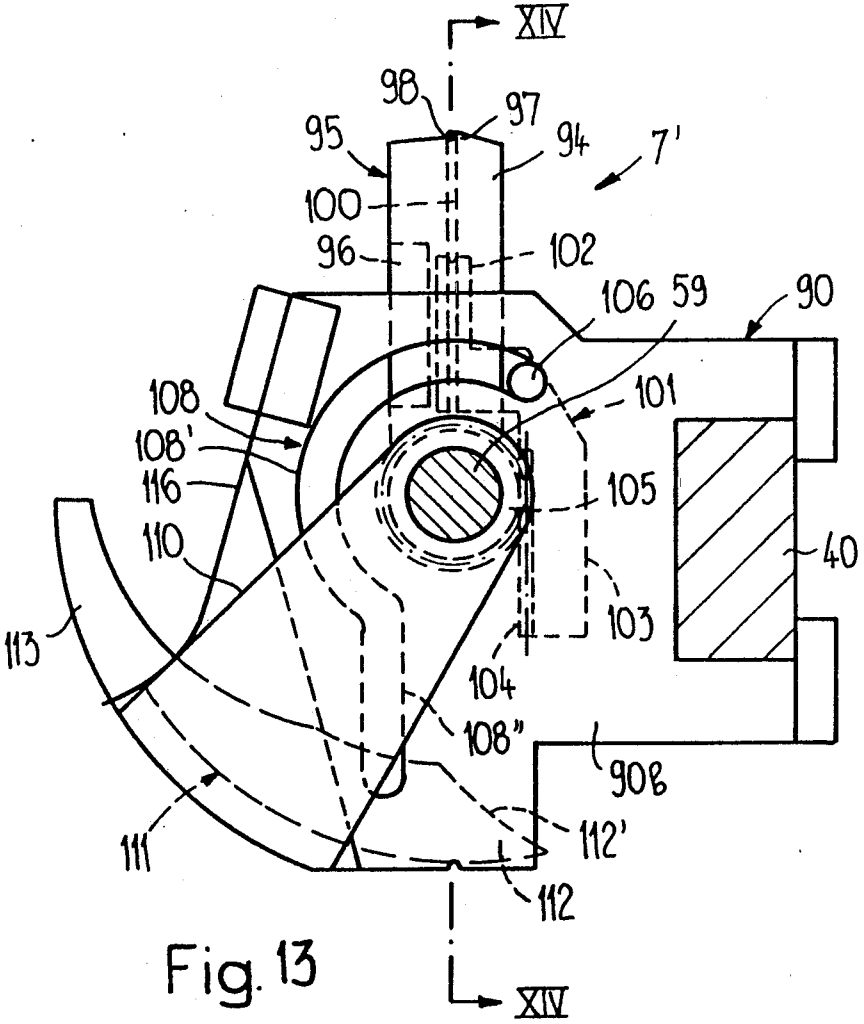
FIG. 13 schematically shows, in a side view, a stapling-head provided in the apparatus according to FIGS. 10 through 12.

FIG. 13 schematically shows in a side view the stapling head 7' of the apparatus depicted in FIGS. 10, 11 and 12, while FIG. 14 schematically shows a cross-section taken substantially along the line XIV—XIV in FIG. 13. The stapling head 7' depicted in its initial or nonoperative position as illustrated in FIG. 10 possesses a supporting member 90 mounted at the transverse bar or beam 40 better seen by referring to FIGS. 10 through 12. This supporting member 90 comprises two lateral bearing parts **90*a* and 90*b* which extend substantially parallel to each other and are arranged in a spaced relationship to one another, as depicted best in FIG. 14. In these lateral bearing parts 90*a* and 90*b* of the supporting member 90 there are freely rotatably mounted respective bearing sleeves 91 and 92. The shaft 59 extends through the bearing sleeves 91 and 92 and is freely rotatable relative to these bearing sleeves 91 and 92, as best seen by referring by FIG. 14. The pivoting axis of the shaft 59 is shown as a dash-dot line and designated by reference numeral 59*a*. Two arm-type die members 93 and 94 of a shaping male die 95 are arranged between the two lateral bearing parts 90*a* and 90*b*. These arm-type die members 93 and 94 extend substantially parallel to each other and are integrally structured with their respective bearing sleeves 91 and 92. Furthermore, the arm-type die members 93 and 94, connected by a web plate 96 as indicated in FIG. 13, each comprise at their free end an entraining nose or catch 97, at which a straight piece or length of wire 98 depicted up at the associated wire-length dispenser unit 11' comes to rest. The straight piece or length of wire 98 is appropriately held or retained at the male die 95** in a not particularly illustrated manner, for example, by magnetic force.

Figure 16:
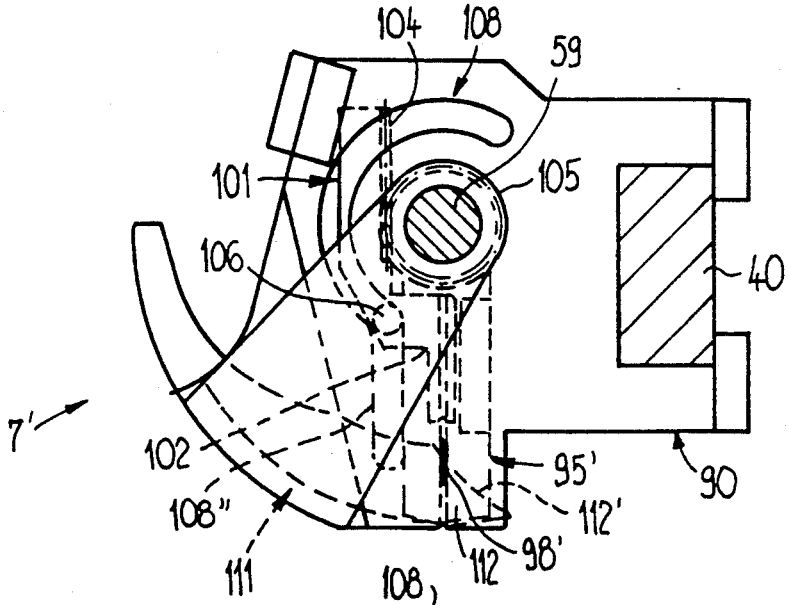

The arm-type die members 93 and 94 comprise at their inner side respective grooves or slots 99 and 100 which are open towards one another and extend in the radial direction over the entire length of the arm-type die members 93 and 94. These grooves 99 and 100 are open towards one another and extend in the radial direction over the entire length of the arm-type die members 93 and 94. These grooves 99 and 100 are open at one end thereof in the region of the straight piece or length of wire 98 retained at the male die 95. A plunger 101 is arranged between the two arm type die members 93 and 94. The plunger 101 is displaceably guided in the radial direction by means of its plunger head 102 in guideways provided in the male die 95, as shown in FIG. 14. The plunger head 102 is connected to an actuating part or portion 103 at which there is structured a toothed rack 104. The toothed rack 104 extends substantially parallel to the longitudinal extension of the arm-type die members 93 and 94 and meshes with a pinion 105 which is arranged between the rotatable bearing sleeves 91 and 92 and nonrotatably seated at the shaft 59 in a manner such as to be nonrotatable relative thereto. In the extension of the toothed rack 104 in the direction toward the plunger head 102, there is provided a guide pin or bolt 106 which projects or protrudes at both sides thereof beyond the plunger 101 and engages in respective identical control cams or tracks 107 and 108 structured in the lateral bearing parts **90*a* and 90*b* of the supporting member 90. These two identical control cams or tracks 107 and 108 each comprise a first section, of which only one is visible in FIG. 13 and designated by reference numeral 108'. Such first section 108' and, accordingly, the other identical first section 107' not visible in FIGS. 13 through 117, extend coaxially with respect to the rotatable shaft 59 through an angle of approximately 180°, and verge onto respective straight or linear sections 108" and 107" (not visible) extending downwardly and away from the rotatable shaft 59. These straight or linear sections 107" and 108" of the identical control cams or tracks 107 and 108 extend substantially parallel to the grooves 99 and 100 of the male die 55 when the latter is located in its staple-insertion position, as depicted in FIG. 16**.

Two pivot levers 109 and 110 arranged outside of the two lateral bearing pars **90*a* and 90*b*, respectively, are pivotably mounted at the rotatable shaft 59. In the region or area of their respective free ends, these two pivot levers 109 and 110 are connected by a staple-guiding member 111. The staple-guiding member 111 comprises a staple-guiding nose 112 which projects beyond the two pivot levers 109 and 110. On the side remote from the staple guiding nose 112 there is appropriately formed at the staple guiding member 111 a bending cam 113 serving as a female die. This bending cam 113 and the staple-guiding member 111 define recesses 114 and 115 extending substantially parallel to one another, as depicted in FIG. 14. Upon pivoting movement of the shaping male die 95 from the initial or nonoperative position to the staple-inserting position thereof, the respective end portions of the two arm-type die members 93 and 94 come to rest in the two parallel recesses 114 and 115. In the region of the staple-guiding nose 112 projecting beyond the pivot levers 109 and 110, the staple-guiding member 111 tapers or narrows outwards to be substantially wedge-shaped. The wedge surface has been designated by reference numeral 112'. A suitable leaf spring 116 is mounted at the lateral bearing part 90*b* of the supporting member 90. The leaf spring 116 which acts upon the pivot lever 110 and thereby presses the connected pivot levers 109 and 110 together with the staple-guiding member 111 and the bending cam 113 (female die) towards the supporting member 90 in counter-clockwise direction with respect to FIG. 13**.

Figure 15:
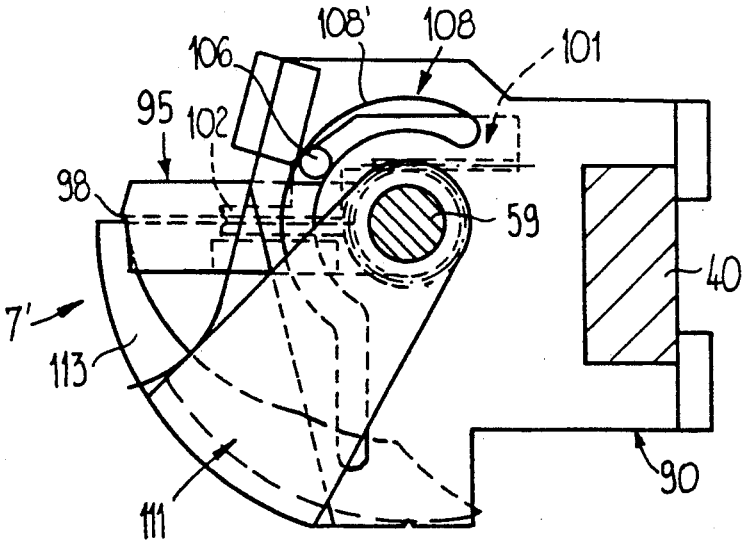
FIGS. 15 through 17 schematically show the stapling-head according to FIGS. 13 and 14 in three different phases of an operating cycle.
Figure 17:
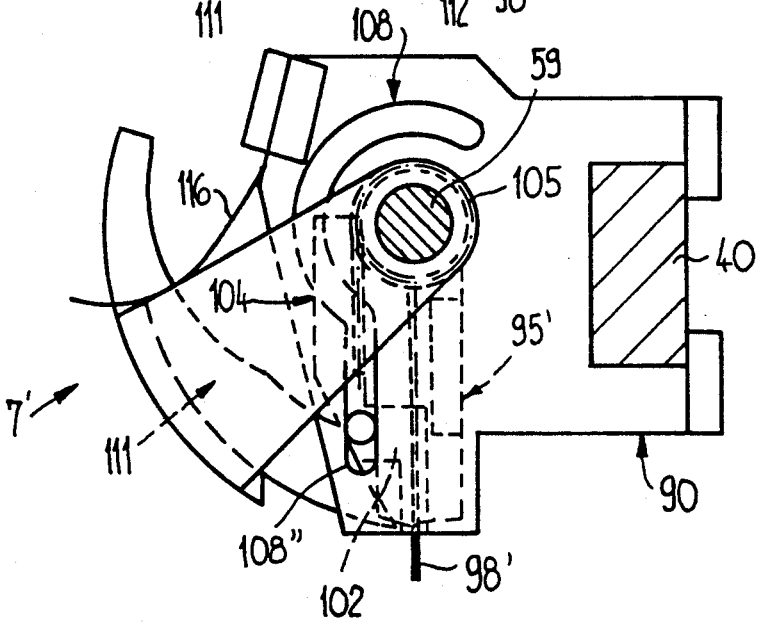

As previously mentioned, the male die 95 is depicted in FIGS. 13 and 14 in its initial or nonoperative position. In FIG. 15, the male die 95 is shown pivoted in counter-clockwise direction through approximately 90° with respect to the initial or nonoperative position thereof. In FIGS. 16 and 17, the male die 95 is located in its staple-insertion position 95' subsequent to pivoting travel through approximately 180°. In FIG. 17, the plunger 101 is shown in the area of its lower end position in which a staple 98' (approximately formed out of the straight piece or length of wire 98) is ejected from the male die 95 and pressed into the respective printed product 4 to be stapled.

The mode of operation of the stapling head 7' will be now explained.

The male die 95 in its initial or nonoperative position, as shown in the stapling head 7' according to FIGS. 13 and 14, takes over a straight piece or length of wire 98 from the respective wire-length dispenser unit 11' not shown in FIGS. 13 through 17. As previously explained with respect to FIGS. 10, 11 and 12, the shaft 59 is pivoted or rotated in counter-clockwise direction to bend the straight piece or length of wire 98 and appropriately form the staple 98' for insertion. As long as the guide pin or bolt 106 is located within the first sections 107' (not visible) and 108' of the identical control cams or tracks 107 and 108, the plunger 101 cannot move in the radial direction with respect to the shaft 59. The male die 95 is coupled with the shaft 59 by means of the plunger 101 and is thus co-rotated. After rotation through 90° in the counter-clockwise direction, the male die 95 arrives in the position depicted in FIG. 15, in which the straight piece or length of wire 98 starts to enter or engage the bending cam 113. In the course of further rotation of the male die 95, the straight piece or length of wire 98 is bent or deformed by the bending cam 113 to form a substantially U-shaped staple 98'. The legs or ends of the staple 98' are guided in the grooves 99 and 100 of the arm-type die members 93 and 94.

As soon as the male die 95 assumes the staple insertion position 95' (FIG. 16) after rotation through 180°, the rotational or tuning connection between the shaft 59 and the male die 95 is removed or lifted. The lifting is due to the fact that the guide pin or bolt 106 now begins to enter the straight or linear sections 107'' (not visible) and 108'' of the identical control cams or tracks 107 and 108, such linear sections 107'' and 108'' extending substantially parallel to the male die 95. Upon further rotation of the shaft 59 in counter-clockwise direction, the guide pin or bolt 106 is guided along the linear sections 107'' and 108'' of the identical control cams 107 and 108. This results in the pinion 105 seated on the shaft 59 rolling along the toothed rack 104 and thereby effects outwards directed travel of the plunger 101 in the radial direction relative to the shaft 59. The plunger 101 bears against the staple 98' and pushes the latter out of the male die 95 in the radial direction. The plunger head 102 thereby comes to bear upon the wedge surface 112' of the staple-guiding nose 112 and pivots, against the force of the leaf spring 116, the staple guide member 111 together with the pivot levers 109 and 110 away in clockwise direction and out of the range of the plunger 101. During ejection of the staple 98' from the male die 95, the legs or ends of the staple 98' are held and conducted within the grooves 99 and 100 of the arm-type die members 93 and 94 by the staple-guiding nose 112, so that the staple 98' is guided during the entire ejecting operation.

As previously mentioned, the ejected staple 98' penetrating through the respective printed product 4 to be stapled is pressed against the respective countersupport 12. Thus, the legs or ends of the staple 98' are bent inwardly such that the staple is secured in the printed product.

Return travel or resetting of the male die 95 is effected by rotation of the rotatable shaft 59 in clockwise direction, this being accomplished as described above with respect to FIGS. 10, 11 and 12. The staple-guiding member 111 is pivoted back by the leaf spring 116 into its initial position depicted in FIGS. 13 and 14, as soon as the plunger 101 has been moved inwardly in the radial direction in the course of the return travel or resetting of male die 95.

It is readily conceivable that stapling heads provided in the exemplary embodiments according to FIGS. 1 through 9 can be differently constructed then described above in conjunction with FIGS. 10 through 17.

While invention has been illustrated and described with respect to the present preferred embodiments of the invention, it is to be distinctly understood that the invention is not limited thereto, but may be otherwise variously embodied and practiced within the scope of the following claims including all equivalents.

I claim:

1. An apparatus for stapling multipart printed products, particularly newspapers, magazines, brochures, the multipart printed products having crease lines and selectively incoming in a contiguously joined formation as a multilayered web or as individual products at a predetermined travel speed, comprising:

a conveying arrangement having a predetermined conveying direction, the crease lines of said multipart printed products extending substantially at right angles to said predetermined conveying direction, said incoming multipart printed products defining a predetermined travel path having a predetermined stapling zone, said conveying arrangement serving to convey the multipart printed products to be stapled along said predetermined travel path and through said predetermined stapling zone;

at least one stapling-head arrangement including a plurality of stapling heads for inserting staples along said crease lines, a first traction member and at least two deflection members, said plurality of stapling heads being mounted in tandem and in a predetermined spaced relationship on said first traction member, said first traction member being guided around said at least two deflection members in said predetermined stapling zone in a direction extending substantially parallel to said predetermined travel path of the multipart printed products, said plurality of stapling heads defining a first closed revolving path having a section located in said predetermined stapling zone, said plurality of stapling heads revolving in a predetermined revolving direction and revolving substantially at said predetermined travel speed of the multipart printed products along said first closed revolving path;

at least one staple-closing arrangement including a plurality of countersupports serving to cooperate in said predetermined stapling zone with said plurality of stapling heads, a second traction member and at least two further deflection members, said plurality of countersupports being mounted on said second traction member, said second traction member being guided around said at least two further deflection members and extending in said predetermined stapling zone in a direction substantially parallel to said predetermined travel path of the multipart printed products, said plurality of countersupports defining a second closed revolving path having a section located in said predetermined stapling zone, said countersupports each having closing means for closing staples inserted by said plurality of stapling heads, said countersupports revolving synchronously with said stapling heads along said second closed revolving path, and said section of said second closed revolving path being arranged opposite said first closed revolving path of said plurality of stapling heads with respect to said predetermined travel path of the multipart printed products;

a wire-length dispenser unit arranged stationarily at said first closed revolving path of said plurality of stapling heads; and said plurality of stapling heads traveling past said wire-length dispenser unit in said predetermined revolving direction and thereby taking over respective wire lengths.

2. The apparatus as defined in claim 1, wherein:

said wire-length dispenser unit is arranged outside of said predetermined stapling zone.

3. The apparatus as defined in claim 1, wherein:

said at least one stapling-head arrangement is separated from said conveying arrangement.

4. The apparatus as defined in claim 1, including:

means for guiding said multipart printed products in a substantially stretched condition through said predetermined stapling zone.

5. The apparatus as defined in claim 1, wherein:

said at least one stapling-head arrangement comprises a first stapling-head arrangement and a second stapling-head arrangement;

said at least one staple-closing arrangement comprises a first staple-closing arrangement and a second staple-closing arrangement;

said second staple-closing arrangement being operatively associated with said second stapling-head arrangement; and said second stapling-head arrangement and said second staple-closing arrangement being arranged in spaced relationship with respect to said first stapling-head arrangement and said first staple-closing arrangement in a direction extending substantially at right angles to said predetermined travel path of the multipart printed products.

6. The apparatus as defined in claim 1, wherein:

said first closed revolving path of said plurality of stapling heads possesses an inner side; and said wire-length dispenser unit being arranged at said inner side of said first closed revolving path.

7. The apparatus as defined in claim 1, wherein:

said wire-length dispenser unit feeds straight lengths of wire to said plurality of stapling heads; and said straight lengths of wire being bent to form substantially U-shaped staples during transport thereof to said predetermined stapling zone.

8. A method of stapling multipart printed products, said multipart printed products having crease lines and selectively incoming in a contiguously joined formation as a multilayered web or as individual products at a predetermined travel speed, said method comprising the steps of:

defining a predetermined travel path having a predetermined stapling zone with said incoming multipart printed products;

conveying said multipart printed products in a predetermined conveying direction, said predetermined direction being such that the crease lines of said multipart printed products extend substantially at right angles to said predetermined conveying direction and said multipart printed products being conveyed to be stapled along said predetermined travel path and through said predetermined stapling zone;

providing at least one stapling-head arrangement including providing a plurality of stapling heads for inserting staples along said crease lines, mounting said plurality of stapling heads in tandem and in a predetermined spaced relationship in a predetermined revolving direction on a first traction member, guiding said first traction member around at least two deflection members in said predetermined stapling zone in a direction extending substantially parallel to said predetermined travel path of the multipart printed products, said plurality of stapling heads defining a first closed revolving path;

revolving said plurality of stapling heads in said predetermined revolving direction substantially at said predetermined travel speed of said multipart printed products along said first closed revolving path, providing at least one staple-closing arrangement including providing a plurality of countersupports serving to cooperate in said predetermined stapling zone with said plurality of stapling heads, said countersupports each having closing means for closing staples inserted by said plurality of stapling heads, mounting said plurality of countersupports on a second traction member, guiding said second traction member around at least two further deflection members, and extending said second traction member in said predetermined stapling zone in a direction substantially parallel to said predetermined travel path of the multipart printed products, said plurality of countersupports defining a second closed revolving path;

revolving said countersupports synchronously with said stapling heads along said second closed revolving path;

arranging said section of said second closed revolving path opposite said first closed revolving path of said plurality of stapling heads with respect to said predetermined travel path of the multipart printed products;

providing a wire-length dispenser unit arranged stationarily at said first closed revolving path of said plurality of stapling heads;

moving said plurality of stapling heads past said wire-length dispenser unit in said predetermined revolving direction and taking over respective wire lengths with said stapling heads;

providing a folded-product delivery comprising a collecting cylinder including folding knives; and performing the stapling of said multipart printed upstream of said collecting cylinder, as viewed with respect to said predetermined conveying direction.

9. The method of claim 8 wherein the printed products are from a folded-product delivery of a rotary printing press, said method further including the steps of:

providing a folded-product delivery comprising a collecting cylinder which includes folding knives; and stapling said multipart printed products upstream of said collecting cylinder, as viewed with respect to said predetermined conveying direction.

10. The method of claim 8 wherein the printed products are from a folded-product delivery of a rotary printing press, said method further including the steps of:

providing a folded-product delivery comprising a collecting cylinder and a folding-jaw cylinder; and stapling the multipart printed products between said collecting cylinder and said folding-jaw cylinder.

11. The method as defined in claim 8, comprising:

arranging said wire-length dispenser unit outside of said predetermined stapling zone.

12. The method as defined in claim 8, comprising:

separating said at least one stapling-head arrangement from said conveying arrangement.

13. The method as defined in claim 8, comprising:

guiding said multipart printed products in a substantially stretched condition through said predetermined stapling zone.

14. The method as defined in claim 8, wherein said at least one stapling-head arrangement comprises a first stapling-head arrangement and a second stapling-head arrangement, said at least one staple-closing arrangement comprises a first staple-closing arrangement and a second staple-closing arrangement and comprising:

operatively associating said second staple-closing arrangement with said second stapling-head arrangement; and arranging said second stapling-head arrangement and said second staple-closing arrangement in spaced relationship with respect to said first stapling-head arrangement and said first staple-closing arrangement in a direction extending substantially at right angles to said predetermined travel path of the multipart printed products.

15. The method as defined in claim 8, wherein said first closed revolving path of said plurality of stapling heads possesses an inner side and comprising:

arranging said wire-length dispenser unit at said inner side of said first closed revolving path.

16. An apparatus for stapling multipart printed products, particularly newspapers, magazines, brochures, the multipart printed products having crease lines and selectively incoming in a contiguously joined formation as a multilayered web or as individual products at a predetermined travel speed, comprising:

a conveying arrangement having a predetermined conveying direction, the crease lines of said multipart printed products extending substantially at right angles to said predetermined conveying direction, said incoming multipart printed products defining a predetermined travel path having a predetermined stapling zone, said conveying arrangement serving to convey the multipart printed products to be stapled along said predetermined travel path and through said predetermined stapling zone;

at least one stapling-head arrangement including a plurality of stapling heads for inserting staples along said crease lines, a first traction member and at least two deflection members, said plurality of stapling heads being mounted in tandem and in a predetermined spaced relationship on said first traction member, said first traction member being guided around said at least two deflection members in said predetermined stapling zone in a direction extending substantially parallel to said predetermined travel path of the multipart printed products, said plurality of stapling heads defining a first closed revolving path having a section located in said predetermined stapling zone, and said plurality of stapling heads revolving in a predetermined revolving direction and revolving substantially at said predetermined travel speed of the multipart printed products along said first closed revolving path;

at least one staple-closing arrangement including a plurality of countersupports serving to cooperate in said predetermined stapling zone with said plurality of stapling heads, a rotating cylinder having a circumference defining a second closed revolving path and having a circumferential portion including said predetermined stapling zone, said plurality of countersupports being arranged at said circumference of said rotating cylinder, said multipart printed products being guided over said rotating cylinder along said circumferential portion, said countersupports each having closing means for closing staples inserted by said plurality of stapling heads, said countersupports revolving synchronously with said stapling heads along said second closed revolving path, and said circumferential portion of said second closed revolving path being arranged opposite said first closed revolving path of said plurality of stapling heads with respect to said predetermined travel path of the multipart printed products and extending substantially parallel to said predetermined travel path of the multipart printed products;

a wire-length dispenser unit arranged stationarily at said first closed revolving path of said plurality of stapling heads; and said plurality of stapling heads traveling past said wire-length dispenser unit in said predetermined revolving direction and thereby taking over respective wire lengths.

17. The apparatus as defined in claim 16, wherein:

said wire-length dispenser unit is arranged outside of said predetermined stapling zone.

18. The apparatus as defined in claim 16, wherein:

said at least one stapling-head arrangement is separated from said conveying arrangement.

19. The apparatus as defined in claim 16, including:

means for guiding said multipart printed products in a substantially stretched condition through said predetermined stapling zone.

20. The apparatus as defined in claim 16, wherein:

said at least one stapling-head arrangement comprises a first stapling-head arrangement and a second stapling-head arrangement;

said at least one staple-closing arrangement comprises a first staple-closing arrangement and a second staple-closing arrangement;

said second staple-closing arrangement being operatively associated with said second stapling-head arrangement; and said second stapling-head arrangement and said second staple-closing arrangement being arranged in spaced relationship with respect to said first stapling-head arrangement and said first staple-closing arrangement in a direction extending substantially at right angles to said predetermined travel path of said multipart printed products.

21. The apparatus as defined in claim 16, wherein:

said first closed revolving path of said plurality of stapling heads possesses an inner side; and said wire-length dispenser unit being arranged at said inner side of said first closed revolving path.

22. An apparatus for stapling multipart printed products, particularly newspapers, magazines, brochures, the multipart printed products having crease lines and selectively incoming in a contiguously joined formation as a multilayered web or as individual products at a predetermined travel speed, comprising:

a conveying arrangement having a predetermined conveying direction, the crease lines of said multipart printed products extending substantially at right angles to said predetermined conveying direction, said incoming multipart printed products defining a predetermined travel path having a predetermined stapling zone, said conveying arrangement serving to convey the multipart printed products to be stapled along said predetermined travel path and through said predetermined stapling zone;

at least one stapling-head arrangement including a plurality of stapling heads for inserting staples along said crease lines, said plurality of stapling heads defining a first closed circular revolving path, said plurality of stapling heads revolving in a predetermined revolving direction and revolving substantially at said predetermined travel speed of the multipart printed products along said first closed revolving path, said plurality of stapling heads being arranged in tandem and in a predetermined spaced relationship in said predetermined revolving direction, said first closed revolving path having a section located in said predetermined stapling zone, and said section of said first closed revolving path extending substantially parallel to said predetermined travel path of the multipart printed products;

at least one staple-closing arrangement including a plurality of countersupports serving to cooperate in said predetermined stapling zone with said plurality of stapling heads, a rotating cylinder having a circumference defining a second closed revolving path extending within said circular revolving path of said plurality of stapling heads, said plurality of countersupports being arranged at said circumference of said rotating cylinder, said rotating cylinder having a circumferential portion including said predetermined stapling zone, said multipart printed products being guided over said rotating cylinder along said circumferential portion, said countersupports each having closing means for closing staples inserted by said plurality of stapling heads, said counter-supports revolving synchronously with said stapling heads along said second closed revolving path, and said circumferential portion of said second closed revolving path being arranged opposite said first closed revolving path of said plurality of stapling heads with respect to said predetermined travel path of the multipart printed products and extending substantially parallel to said predetermined travel path of the multipart printed products;

a wire-length dispenser unit arranged stationarily at said first closed revolving path of said plurality of stapling heads; and said plurality of stapling heads traveling past said wire-length dispenser unit in said predetermined revolving direction and thereby taking over respective wire lengths.

23. The apparatus as defined in claim 22, further including:

control means for said plurality of stapling heads guided in said circular revolving path;

said plurality of stapling heads each having a work position and a retracted position;

said rotating cylinder having a predetermined axial direction; and said control means serving to move said stapling heads in said predetermined axial direction between said work position and said retracted position.

24. The apparatus as defined in claim 22, wherein:

said wire-length dispenser unit is arranged outside of said predetermined stapling zone.

25. The apparatus as defined in claim 22, wherein:

said at least one stapling-head arrangement is separated from said conveying arrangement.

26. The apparatus as defined in claim 22, including:

means for guiding said multipart printed products in a substantially stretched condition through said predetermined stapling zone.

27. The apparatus as defined in claim 22, wherein:

said at least one stapling-head arrangement comprises a first stapling-head arrangement and a second stapling-head arrangement;

said at least one staple-closing arrangement comprises a first staple-closing arrangement and a second staple-closing arrangement;

said second staple-closing arrangement being operatively associated with said second stapling-head arrangement; and said second stapling-head arrangement and said second staple-closing arrangement being arranged in spaced relationship with respect to said first stapling-head arrangement and said first staple-closing arrangement in a direction extending substantially at right angles to said predetermined travel path of said multipart printed products.

28. The apparatus as defined in claim 22, wherein:

said first closed revolving path of said plurality of stapling heads possesses an inner side; and said wire-length dispenser unit being arranged at said inner side of said first closed revolving path.

29. An apparatus for stapling multipart printed products, particularly newspapers, magazines, brochures, the multipart printed products having crease lines and selectively incoming in a contiguously joined formation as a multilayered web or as individual products at a predetermined travel speed, comprising:

a conveying arrangement having a predetermined conveying direction, the crease lines of said multipart printed products extending substantially at right angles to said predetermined conveying direction, said incoming multipart printed products defining a predetermined travel path having a predetermined stapling zone, said conveying arrangement serving to convey the multipart printed products to be stapled along said predetermined travel path and through said predetermined stapling zone;

at least one stapling-head arrangement including a plurality of stapling heads for inserting staples along said crease lines, said plurality of stapling heads defining a first closed circular revolving path, said plurality of stapling heads revolving in a predetermined revolving direction and revolving substantially at said predetermined travel speed of the multipart printed products along said first closed revolving path, said plurality of stapling heads being arranged in tandem and in a predetermined spaced relationship in said predetermined revolving direction, said first closed revolving path having a section located in said predetermined stapling zone, and said section of said first closed revolving path extending substantially parallel to said predetermined travel path of the multipart printed products;

at least one staple-closing arrangement including a plurality of countersupports serving to cooperate in said predetermined stapling zone with said plurality of stapling heads, a collecting cylinder of a folded-product delivery of a rotary printing press, said collecting cylinder having a substantially circular circumference defining a second closed revolving path extending within said circular revolving path of said plurality of stapling heads and having a section located in said predetermined stapling zone, said plurality of counter-supports being arranged at said substantially circular circumference of said collecting cylinder, said countersupports each having closing means for closing staples inserted by said plurality of stapling heads, said countersupports revolving synchronously with said stapling heads along said second closed revolving path, and said section of said second closed revolving path being arranged opposite said first closed revolving path of said plurality of stapling heads with respect to said predetermined travel path of the multipart printed products and extending substantially parallel to said predetermined travel path of the multipart printed products;

a wire-length dispenser unit arranged stationarily at said first closed revolving path of said plurality of stapling heads; and said plurality of stapling heads traveling past said wire-length dispenser unit in said predetermined revolving direction and thereby taking over respective wire lengths.

30. The apparatus as defined in claim 29, wherein:

said collecting cylinder includes folding knives; and said plurality of countersupports being arranged in the region of said folding knives.

31. The apparatus as defined in claim 29, wherein:

said wire-length dispenser unit is arranged outside of said predetermined stapling zone.

32. The apparatus as defined in claim 29, wherein:

said at least one stapling-head arrangement is separated from said conveying arrangement.

33. The apparatus as defined in claim 29, including:

means for guiding said multipart printed products in a substantially stretched condition through said predetermined stapling zone.

34. The apparatus as defined in claim 29, wherein:

said at least one stapling-head arrangement comprises a first stapling-head arrangement and a second stapling-head arrangement;

said at least one staple-closing arrangement comprises a first staple-closing arrangement and a second staple-closing arrangement;

said second staple-closing arrangement being operatively associated with said second stapling-head arrangement; and said second stapling-head arrangement and said second staple-closing arrangement being arranged in spaced relationship with respect to said first stapling-head arrangement and said first staple-closing arrangement in a direction extending substantially at right angles to said predetermined travel path of the multipart printed products.

35. The apparatus as defined in claim 29, wherein:

said first closed revolving path of said plurality of stapling heads possesses an inner side; and said wire-length dispenser unit being arranged at said inner side of said first closed revolving path.

36. A method of stapling multipart printed products, said multipart printed products having crease lines and selectively incoming in a contiguously joined formation as a multilayered web or as individual products at a predetermined travel speed, said method comprising the steps of:

defining a predetermined travel path having a predetermined stapling zone with said incoming multipart printed products;

conveying said multipart printed products in a predetermined conveying direction, said predetermined direction being such that the crease lines of said multipart printed products extend substantially at right angles to said predetermined conveying direction and said multipart printed products being conveyed to be stapled along said predetermined travel path and through said predetermined stapling zone;

providing at least one stapling-head arrangement including providing a plurality of stapling heads for inserting staples along said crease lines, mounting said plurality of stapling heads in tandem and in a predetermined spaced relationship in a predetermined revolving direction on a first traction member, guiding said first traction member around at least two deflection members in said predetermined stapling zone in a direction extending substantially parallel to said predetermined travel path of the multipart printed products, said plurality of stapling heads defining a first closed revolving path;

revolving said plurality of stapling heads in said predetermined revolving direction substantially at said predetermined travel speed of said multipart printed products along said first closed revolving path;

providing at least one staple-closing arrangement including providing a plurality of countersupports serving to cooperate in said predetermined stapling zone with said plurality of stapling heads, said countersupports each having closing means for closing staples inserted by said plurality of stapling heads, providing a rotating cylinder having a circumference defining a second closed revolving path, arranging said plurality of countersupports at said circumference of said rotating cylinder, said rotating cylinder having a circumferential portion including said predetermined stapling zone, and guiding said multipart printed products over said rotating cylinder along said circumferential portion;

revolving said countersupports synchronously with said stapling heads along said second closed revolving path;

arranging said circumferential portion of said second closed revolving path opposite said first closed revolving path of said plurality of stapling heads with respect to said predetermined travel path of the multipart printed products and such that said circumferential portion of said second closed revolving path extends substantially parallel to said predetermined travel path of the multipart printed products;

providing a wire-length dispenser unit arranged stationarily at said first closed revolving path of said plurality of stapling heads;

moving said plurality of stapling heads past said wire-length dispenser unit in said predetermined revolving direction and taking over respective wire lengths with said stapling heads;

providing a folded-product delivery comprising a collecting cylinder including folding knives; and performing the stapling of said multipart printed upstream of said collecting cylinder, as viewed with respect to said predetermined conveying direction.

37. The method as defined in claim 36, comprising:

arranging said wire-length dispenser unit outside of said predetermined stapling zone.

38. The method as defined in claim 36, comprising:

separating said at least one stapling-head arrangement from said conveying arrangement.

39. The method as defined in claim 36, comprising:

guiding said multipart printed products in a substantially stretched condition through said predetermined stapling zone.

40. The method as defined in claim 36, wherein said at least one stapling-head arrangement comprises a first stapling-head arrangement and a second stapling-head arrangement, said at least one staple-closing arrangement comprises a first staple-closing arrangement and a second staple-closing arrangement and comprising:

operatively associating said second staple-closing arrangement with said second stapling-head arrangement; and arranging said second stapling-head arrangement and said second staple-closing arrangement in spaced relationship with respect to said first stapling-head arrangement and said first staple-closing arrangement in a direction extending substantially at right angles to said predetermined travel path of the multipart printed products.

41. The method as defined in claim 36, wherein said first closed revolving path of said plurality of stapling heads possesses an inner side and comprising:

arranging said wire-length dispenser unit at said inner side of said first closed revolving path.

42. A method of stapling multipart printed products from a folded-product delivery of a rotary printing press, said multipart printed products having crease lines and selectively incoming in a contiguously joined formation as a multilayered web or as individual products at a predetermined travel speed, said method comprising the steps of:

defining a predetermined travel path having a predetermined stapling zone with said incoming multipart printed products;

conveying said multipart printed products in a predetermined conveying direction, said predetermined direction being such that the crease lines of said multipart printed products extend substantially at right angles to said predetermined conveying direction and said multipart printed products being conveyed to be stapled along said predetermined travel path and through said predetermined stapling zone;

providing at least one stapling-head arrangement including a plurality of stapling heads for inserting staples along said crease lines, said plurality of stapling heads defining a first circular closed revolving path;

arranging said plurality of stapling heads in tandem and in a predetermined spaced relationship in a predetermined revolving direction;

revolving said plurality of stapling heads in said predetermined revolving direction substantially at said predetermined travel speed of said multipart printed products along said first closed revolving path;

placing a section of said first closed revolving path in said predetermined stapling zone, said section of said first closed revolving path extending substantially parallel to said predetermined travel path of the multipart printed products;

providing at least one staple-closing arrangement including providing a plurality of countersupports serving to cooperate in said predetermined stapling zone with said plurality of stapling heads, said countersupports each having closing means for closing staples inserted by said plurality of stapling heads, providing a rotating cylinder having a circumference defining a second closed revolving path extending within said circular revolving path of said plurality of stapling heads, arranging said plurality of countersupports at said circumference of said rotating cylinder, said rotating cylinder having a circumferential portion including said predetermined stapling zone, and guiding said multipart printed products over said rotating cylinder along said circumferential portion;

revolving said countersupports synchronously with said stapling heads along said second closed revolving path;

arranging said circumferential portion of said second closed revolving path opposite said first closed revolving path of said plurality of stapling heads with respect to said predetermined travel path of the multipart printed products and such that said circumferential portion of said second closed revolving path extends substantially parallel to said predetermined travel path of the multipart printed products;

providing a wire-length dispenser unit arranged stationarily at said first closed revolving path of said plurality of stapling heads;

moving said plurality of stapling heads past said wire-length dispenser unit in said predetermined revolving direction and taking over respective wire lengths with said stapling heads;

providing a folded-product delivery comprising a collecting cylinder which includes folding knives; and stapling said multipart printed products upstream of said collecting cylinder, as viewed with respect to said predetermined conveying direction.

43. The method as defined in claim 42, comprising:

arranging said wire-length dispenser unit outside of said predetermined stapling zone.

44. The method as defined in claim 42, comprising:

separating said at least one stapling-head arrangement from said conveying arrangement.

45. The method as defined in claim 42, comprising:

guiding said multipart printed products in a substantially stretched condition through said predetermined stapling zone.

46. The method as defined in claim 42, wherein said at least one stapling-head arrangement comprises a first stapling-head arrangement and a second stapling-head arrangement, said at least one staple-closing arrangement comprises a first staple-closing arrangement and a second staple-closing arrangement and comprising:

operatively associating said second staple-closing arrangement with said second stapling-head arrangement; and arranging said second stapling-head arrangement and said second staple-closing arrangement in spaced relationship with respect to said first stapling-head arrangment and said first staple-closing arrangement in a direction extending substantially at right angles to said predetermined travel path of the multipart printed products.

47. The method as defined in claim 42, wherein said first closed revolving path of said plurality of stapling heads possesses an inner side, and comprising:

arranging said wire-length dispenser unit at said inner side of said first closed revolving path.

48. A method of stapling multipart printed products from a folded-product delivery of a rotary printing press, said multipart printed products having crease lines and selectively incoming in a contiguously joined formation as a multilayered web or as individual products at a predetermined travel speed, said method comprising the steps of:

defining a predetermined travel path having a predetermined stapling zone with said incoming multipart printed products;

conveying said multipart printed products in a predetermined conveying direction, said predetermined direction being such that the crease lines of said multipart printed products extend substantially at right angles to said predetermined conveying direction and said multipart printed products being conveyed to be stapled along said predetermined travel path and through said predetermined stapling zone;

providing at least one stapling-head arrangement including providing a plurality of stapling heads for inserting staples along said crease lines, mounting said plurality of stapling heads in tandem and in a predetermined spaced relationship in a predetermined revolving direction on a first traction member, guiding said first traction member around at least two deflection members in said predetermined stapling zone in a direction extending substantially parallel to said predetermined travel path of the multipart printed products, said plurality of stapling heads defining a first closed revolving path;

revolving said plurality of stapling heads in said predetermined revolving direction substantially at said predetermined travel speed of said multipart printed products along said first closed revolving path;

providing at least one staple-closing arrangement including providing a plurality of countersupports serving to cooperate in said predetermined stapling zone with said plurality of stapling heads, said countersupports each having closing means for closing staples inserted by said plurality of stapling heads, mounting said plurality of countersupports on a second traction member, guiding said second traction member around at least two further deflection members, and extending said second traction member in said predetermined stapling zone in a direction substantially parallel to said predetermined travel path of the multipart printed products, said plurality of countersupports defining a second closed revolving path;

revolving said countersupports synchronously with said stapling heads along said second closed revolving path;

arranging a section of said second closed revolving path opposite said first closed revolving path of said plurality of stapling heads with respect to said predetermined travel path of the multipart printed products;

providing a wire-length dispenser unit arranged stationarily at said first closed revolving path of said plurality of stapling heads;

moving said plurality of stapling heads past said wire-length dispenser unit in said predetermined revolving direction and taking over respective wire lengths with said stapling heads;

providing a folded-product delivery comprising a collecting cylinder and a folding-jaw cylinder; and stapling the multipart printed products between said collecting cylinder and said folding-jaw cylinder.

49. The method as defined in claim 48, comprising:

arranging said wire-length dispenser unit outside of said predetermined stapling zone.

50. The method as defined in claim 48, comprising:

separating said at least one stapling-head arrangement from said conveying arrangement.

51. The method as defined in claim 48, comprising:

guiding said multipart printed products in a substantially stretched condition through said predetermined stapling zone.

52. The method as defined in claim 48, wherein said at least one stapling-head arrangement comprises a first stapling-head arrangement and a second stapling-head arrangement, said at least one staple-closing arrangement comprises a first staple-closing arrangement and a second staple-closing arrangement and comprising:

operatively associating said second staple-closing arrangement with said second stapling-head arrangement; and arranging said second stapling-head arrangement and said second staple-closing arrangement in spaced relationship with respect to said first stapling-head arrangement and said first staple-closing arrangement in a direction extending substantially at right angles to said predetermined travel path of the multipart printed products.

53. The method as defined in claim 48, wherein said first closed revolving path of said plurality of stapling heads possesses an inner side, and comprising:

arranging said wire-length dispenser unit at said inner side of said first closed revolving path.

54. A method of stapling multipart printed products from a folded-product delivery of a rotary printing press, said multipart printed products having crease lines and selectively incoming in a contiguously joined formation as a multilayered web or as individual products at a predetermined travel speed, said method comprising the steps of:

defining a predetermined travel path having a predetermined stapling zone with said incoming multipart printed products;

conveying said multipart printed products in a predetermined conveying direction, said predetermined direction being such that the crease lines of said multipart printed products extend substantially at right angles to said predetermined conveying direction and said multipart printed products being conveyed to be stapled along said predetermined travel path and through said predetermined stapling zone;

providing at least one stapling-head arrangement including providing a plurality of stapling heads for inserting staples along said crease lines, mounting said plurality of stapling heads in tandem and in a predetermined spaced relationship in a predetermined revolving direction on a first traction member, guiding said first traction member around at least two deflection members in said predetermined stapling zone in a direction extending substantially parallel to said predetermined travel path of the multipart printed products, said plurality of stapling heads defining a first closed revolving path;

revolving said plurality of stapling heads in said predetermined revolving direction substantially at said predetermined travel speed of said multipart printed products along said first closed revolving path;

providing at least one staple-closing arrangement including providing a plurality of countersupports serving to cooperate in said predetermined stapling zone with said plurality of stapling heads, said countersupports each having closing means for closing staples inserted by said plurality of stapling heads, providing a rotating cylinder having a circumference defining a second closed revolving path, arranging said plurality of countersupports at said circumference of said rotating cylinder, said rotating cylinder having a circumferential portion including said predetermined stapling zone, and guiding said multipart printed products over said rotating cylinder along said circumferential portion;

revolving said countersupports synchronously with said stapling heads along said second closed revolving path;

arranging said circumferential portion of said second closed revolving path opposite said first closed revolving path of said plurality of stapling heads with respect to said predetermined travel path of the multipart printed products and such that said circumferential portion of said second closed revolving path extends substantially parallel to said predetermined travel path of the multipart printed products;

providing a wire-length dispenser unit arranged stationarily at said first closed revolving path of said plurality of stapling heads;

moving said plurality of stapling heads past said wire-length dispenser unit in said predetermined revolving direction and taking over respective wire lengths with said stapling heads;

providing a folded-product delivery comprising a collecting cylinder and a folding-jaw cylinder; and stapling the multipart printed products between said collecting cylinder and said folding-jaw cylinder.

55. The method as defined in claim 54, comprising:

arranging said wire-length dispenser unit outside of said predetermined stapling zone.

56. The method as defined in claim 54, comprising:

separating said at least one stapling-head arrangement from said conveying arrangement.

57. The method as defined in claim 54, comprising:

guiding said multipart printed products in a substantially stretched condition through said predetermined stapling zone.

58. The method as defined in claim 54, wherein said at least one stapling-head arrangement comprises a first stapling-head arrangement and a second stapling-head arrangement, said at least one staple-closing arrangement comprises a first staple-closing arrangement and a second staple-closing arrangement and comprising:

operatively associating said second staple-closing arrangement with said second stapling-head arrangement; and arranging said second stapling-head arrangement and said second staple-closing arrangement in spaced relationship with respect to said first stapling-head arrangement and said first staple-closing arrangement in a direction extending substantially at right angles to said predetermined travel path of the multipart printed products.

59. The method as defined in claim 54, wherein said first closed revolving path of said plurality of stapling heads possesses an inner side, and comprising:

arranging said wire-length dispenser unit at said inner side of said first closed revolving path.

60. A method of stapling multipart printed products from a folded-product delivery of a rotary printing press, said multipart printed products having crease lines and selectively incoming in a contiguously joined formation as a multilayered web or as individual products at a predetermined travel speed, said method comprising the steps of:

defining a predetermined travel path having a predetermined stapling zone with said incoming multipart printed products;

conveying said multipart printed products in a predetermined conveying direction, said predetermined direction being such that the crease lines of said multipart printed products extend substantially at right angles to said predetermined conveying direction and said multipart printed products being conveyed to be stapled along said predetermined travel path and through said predetermined stapling zone;

providing at least one stapling-head arrangement including a plurality of stapling heads for inserting staples along said crease lines, said plurality of stapling heads defining a first circular closed revolving path;

arranging said plurality of stapling heads in tandem and in a predetermined spaced relationship in a predetermined revolving direction;

revolving said plurality of stapling heads in said predetermined revolving direction substantially at said predetermined travel speed of said multipart printed products along said first closed revolving path;

placing a section of said first closed revolving path in said predetermined stapling zone, said section of said first closed revolving path extending substantially parallel to said predetermined travel path of the multipart printed products;

providing at least one staple-closing arrangement including providing a plurality of countersupports serving to cooperate in said predetermined stapling zone with said plurality of stapling heads, said countersupports each having closing means for closing staples inserted by said plurality of stapling heads, providing a rotating cylinder having a circumference defining a second closed revolving path, arranging said plurality of countersupports at said circumference of said rotating cylinder, said rotating cylinder having a circumferential portion including said predetermined stapling zone, guiding said multipart printed products over said rotating cylinder along said circumferential portion, said plurality of countersupports defining a second closed revolving path, and extending said second closed revolving path of said plurality of countersupports within said circular revolving path of said plurality of stapling heads;

revolving said countersupports synchronously with said stapling heads along said second closed revolving path;

arranging said circumferential portion of said second closed revolving path opposite said first closed revolving path of said plurality of stapling heads with respect to said predetermined travel path of the multipart printed products and such that said circumferential portion of said second closed revolving path extends substantially parallel to said predetermined travel path of the multipart printed products;

providing a wire-length dispenser unit arranged stationarily at said first closed revolving path of said plurality of stapling heads;

moving said plurality of stapling heads past said wire-length dispenser unit in said predetermined revolving direction and taking over respective wire lengths with said stapling heads;

providing a folded-product delivery comprising a collecting cylinder and a folding-jaw cylinder; and stapling the multipart printed products between said collecting cylinder and said folding-jaw cylinder.

61. The method as defined in claim 60, comprising:

arranging said wire-length dispenser unit outside of said predetermined stapling zone.

62. The method as defined in claim 60, comprising:

separating said at least one stapling-head arrangement from said conveying arrangement.

63. The method as defined in claim 60, comprising:

guiding said multipart printed products in a substantially stretched condition through said predetermined stapling zone.

64. The method as defined in claim 60, wherein said at least one stapling-head arrangement comprises a first stapling-head arrangement and a second stapling-head arrangement, said at least one staple-closing arrangement comprises a first staple-closing arrangement and a second staple-closing arrangement and comprising:

operatively associating said second staple-closing arrangement with said second stapling-head arrangement; and arranging said second stapling-head arrangement and said second staple-closing arrangement in spaced relationship with respect to said first stapling-head arrangement and said first staple-closing arrangement in a direction extending substantially at right angles to said predetermined travel path of the multipart printed products.

65. The method as defined in claim 60, wherein said first closed revolving path of said plurality of stapling heads possesses an inner side, and comprising:

arranging said wire-length dispenser unit at said inner side of said first closed revolving path.

* * * * *

UNITED STATES PATENT AND TRADEMARK OFFICE

CERTIFICATE OF CORRECTION

PATENT NO. : 5,174,557
DATED : December 29, 1992
INVENTOR(S) : Jacques Meier

It is certified that error appears in the above-indentified patent and that said Letters Patent is hereby corrected as shown below:

On the title page, Item [30]:

IN THE FOREIGN APPLICATION PRIORITY DATA

On the title page, column 1, after "Switzerland" delete "2564/90" and substitute therefor --2564/90-B--.

In column 2, line 19, delete "staled" and substitute --stapled--.

In column 3, line 10, delete "head" and substitute therefor --heads--.

In column 4, line 19, after "now" insert --to--.

In column 6, line 6, after "construction" delete "," and substitute therefor --.--.

In column 6, line 51, delete "time".

In column 7, line 22, after "paths" delete "1" and substitute therefor --U--.

UNITED STATES PATENT AND TRADEMARK OFFICE

CERTIFICATE OF CORRECTION

PATENT NO. : 5,174,557

DATED : December 29, 1992

INVENTOR(S) : Jacques Meier

It is certified that error appears in the above-indentified patent and that said Letters Patent is hereby corrected as shown below:

In column 10, line 66, delete "ever" and substitute therefor --lever--.

In column 12, line 3, after "referring" delete "by" and substitute --to--.

In column 12, line 52, delete "117" and substitute therefor --17--.

In column 12, line 63, delete "pars" and substitute therefor --parts--.

In column 13, line 33, delete "(approximately" and substitute therefor --appropriately--.

In column 14, line 43, after "While" insert --the--.

Signed and Sealed this

Third Day of May, 1994

Bruce Lehman

*Attest:*

BRUCE LEHMAN

*Attesting Officer*

*Commissioner of Patents and Trademarks*